US006336697B1

(12) United States Patent
Fukushima

(10) Patent No.: US 6,336,697 B1
(45) Date of Patent: Jan. 8, 2002

(54) LIQUID JET STRUCTURE, INK JET TYPE RECORDING HEAD AND PRINTER

(75) Inventor: Hitoshi Fukushima, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/402,053

(22) PCT Filed: Jan. 26, 1999

(86) PCT No.: PCT/JP99/00315

§ 371 Date: Sep. 28, 1999

§ 102(e) Date: Sep. 28, 1999

(87) PCT Pub. No.: WO99/38694

PCT Pub. Date: Aug. 5, 1999

(30) Foreign Application Priority Data

Jan. 28, 1998 (JP) ..... 10-16236

(51) Int. Cl.[7] ..... B41J 2/135
(52) U.S. Cl. ..... 347/20
(58) Field of Search ..... 347/20, 45, 46, 347/47, 55, 68, 70, 71

(56) References Cited

U.S. PATENT DOCUMENTS

| | | | | |
|---|---|---|---|---|
| 4,166,277 A | | 8/1979 | Cielo et al. | 347/55 |
| 5,598,193 A | | 1/1997 | Halko et al. | 347/45 |
| 6,074,040 A | * | 6/2000 | Usui et al. | 347/45 |
| 6,102,521 A | * | 8/2000 | Halko et al. | 347/47 |

FOREIGN PATENT DOCUMENTS

| | | |
|---|---|---|
| EP | 0 529 078 A1 | 3/1993 |
| EP | 0829 357 A1 | 3/1998 |
| WO | WO097/27059 | 7/1997 |
| WO | WO99/17083 | 4/1999 |

OTHER PUBLICATIONS

English Abstract of JP 7–246707, Sep. 26, 1995.
English Abstract of JP 6–32868, Nov. 29, 1994.
English Abstract of JP 60–178065, Sep. 12, 1985.
Fukushima, et al., "Microstructure and Surface Properties of Semi–Fluorinated SAM (Self–Assembly Monolayer)s on Gold"; Nov. 10–11, 1999; Keidanren Kaikan 14F (Keidanren Hall); pp. 109–110.
Koini, et al., "Microstructure and Surface Properties of Semi–Fluorinated SAMs on Gold"; The Japan Society of Applied Physics (The 60$^{th}$ Autumn Meeting, Sep. 1–4, 1999) p1033.

(List continued on next page.)

*Primary Examiner*—Anh T. N. Vo
(74) *Attorney, Agent, or Firm*—Harness, Dickey & Pierce, P.L.C.

(57) ABSTRACT

This invention relates to a liquid jetting structure which comprises a nozzle or nozzles 11 for jetting a liquid 6. What is characteristic of this liquid jetting structure is that a flow path inside the nozzle or nozzles is set so that the degree of affinity for the liquid 6 to be jetted changes in the direction of liquid flow (140, 130). By controlling the affinity in this way, the liguid getting structure is possible to improve the linearity of advance of the liquid droplets, and to stabilize the liquid droplet diameter. Such a liquid jetting structure is suitable for an ink jet recording head.

67 Claims, 12 Drawing Sheets

OTHER PUBLICATIONS

Tamada, et al., "Structure of SAMs generated from functionalized thiols on gold"; Thin Solid Films 327–329 (1998) pp. 150–155.

Evans, et al., "Self–Assembled Monolayers of Alkanethiols Containing a Polar Aromatic Group: Effects of the Dipole Position on Molecular Packaging, Orientation, and Surface Wetting Properties"; J. Am. Chem. Soc. (1991), vol. 113, No. 11, pp. 4121–4131.

Graupe, et al., "Terminally perfluorinated long–chain alkanethiols"; Journal of Fluorine Chemistry 93 (1999) pp. 107–115.

Gang–yu Liu, et al., "An unexpected packaging of fluorinated η–alkane thiols Au(111): A combined atomic force microscopy and x–ray diffraction study"; J. Chem. Phys. vol. 101 no. 5, (Sep. 1, 1994) pp. 4301–4306.

Colin D. Bain, et al., "Depth Sensitivity of Wetting: Monolayers of w–mercapto Ethers on Gold"; Journal American Chemical Society; (1988) vol. 110, pp. 5897–5898.

Colin D. Bain, et al., "Formation of Monolayer Films by the Spontaneous Assembly of Organic Thiols from Solution onto Gold"; Journal American Chemical Society; (1989) vol. 111, pp. 321–335.

T.J. Lenk, et al., "Structural Investigation of Molecular Organization in Self–Assembled Monolayers of a Semifluorinated Amidethiol"; Langmuir, (1994), vol. 10, pp. 4610–4617.

M.–W. Tsao, et al., "Studies of Molecular Orientation and Order in Self–Assembled Semifluorinated η–Alkanethiols: Single and Dual Component Mixtures"; Langmuir, (1997) vol. 13, pp. 4317–4322.

Alves, et al., "Atomic Force Microscopic Characterization of a Fluorinated Alkanethiolate Monolayer at Gold and Correlations to Electrochemical and Infrared Reflection Spectroscopic Structural Descriptions"; Langmuir (1993) vol. 9, pp. 3507–3512.

Chidsey, et al., "Chemical Functionality in Self–Assembled Monolayers: Structural and Electrochemical Properties"; Langmuir (1990) Vo. 6, pp. 682–691.

Colgate et al.; Journal of Vacuum Science Technology, "An investigation of electrowetting–based microactuation", 8(1990) Jul./Aug. , No. 4, New York, US, pp. 3625–3633.

* cited by examiner

THIOL MOLECULES HAVING FUNCTIONAL GROUPS

ETHANOL
1~10mA

1 HOUR
AT ROOM
TEMPRATURE

GOLD SURFACE

SPONTANEOUS AGGREGATION OF THIOL MOLECULES TO GOLD SURFACE

2D MONOMOLECULAR FILM OF THIOL MOLECULES

100 : INK JET PRINTER

101 : INK JET RECORDING HEAD

LIQUID JET STRUCTURE, INK JET TYPE RECORDING HEAD AND PRINTER

TECHNICAL FIELD

This invention relates to industrial applications of ink jet recording heads, and more particularly to modifications in a liquid jetting structure wherewith improvements can be realized in the flight characteristics of the jetted liquid droplets such as linearity of advance and uniformity of liquid droplet quantities.

BACKGROUND ART

The performance of an ink jet recording head is greatly influenced by whether or not the nozzle or nozzles exhibit an affinity for the ink droplets. When the ink droplet jetting surface (i.e. the surface on the jetting side where the nozzle is open) exhibits high affinity for the ink, the ink droplets being jetted are pulled by adhering materials such as paper dust or ink remaining on the jetting surface, and are thus jetted in a bent direction that is not the originally planned jetting direction.

One conventional method for stabilizing the ink droplet jetting direction is to select the material of which the nozzle jetting surface is formed and treat the jetting surface to reduce the degree of ink affinity thereof. A publicized invention for forming nozzle surfaces of a self-aggregating monomolecular film is described in U.S. Pat. No. 5,598,193. According to this treatment method, the jetting surface exhibits hydrophobic properties toward ink, wherefore the ink droplets cease to be jetted in a bent direction.

With the conventional improvement technology described in the foregoing, however, even though the linearity of advance of the liquid droplets can be improved, the volume of liquid jetted from the nozzle or nozzles cannot be stabilized. Because the ink droplet volume is not stabilized, the volume of ink that adheres differs from one liquid droplet to another, so that, in some cases, high-quality printing cannot be done.

In cases where this ink jet recording head is used in industrial applications, in particular, instability in the liquid droplet volume ejected is a fatal flaw. Industrial applications of ink jet recording heads involve the formation of patterns by jetting not ink but liquids usable in industrial applications from nozzles of ink jet recording heads. In industrial applications wherein ink jet recording heads are used to form patterns, for example, the pitch widths in the patterns to be formed are very fine. Therefore, if the diameter of the liquid droplets jetted is not stabilized, fluctuations appear in the volume of adhering liquid, and patterns cannot be formed with stabilized widths.

This being so, in order to resolve the problems noted in the foregoing, a first object of the present invention is to provide a liquid jetting structure wherewith the linearity of advance of jetted liquid droplets can be enhanced and liquid droplet diameter stabilized.

A second object of the present invention is to provide an ink jet recording head that can be employed in industrial applications as a result of enhancing the linearity of advance of jetted liquid droplets and stabilizing the liquid droplet diameter.

A third object of the present invention is to provide a printer capable of printing with high print quality as a result of enhancing the linearity of advance of jetted liquid droplets and stabilizing the liquid droplet diameter.

DISCLOSURE OF THE INVENTION

In view of the problems noted in the foregoing, the inventor analyzed the behavior of liquids such as ink as they advance through a nozzle and are jetted as liquid droplets. As a result, the following facts were learned. As a liquid travels through the flow path of a nozzle, if the degree of affinity for the liquid suddenly declines, at that point of discontinuity, the liquid will separate from the surface of the walls configuring the flow path. The liquid that separates from the wall surface exhibits constriction as it advances further downstream. Then, due to surface tension, the liquid separates, with the significant point being the place of constriction, whereupon the leading portion becomes a liquid droplet and is jetted from the nozzle opening. If the velocity wherewith the liquid is advancing at this time is the same, the position where the significant point develops will be constant, and the diameter of the liquid droplets jetted will also be constant. Thereupon the inventor, using this behavior of liquids, conceived of a structure wherewith liquid droplets are generated stably while varying the degree of affinity of the flow path forming the nozzle.

In other words, the invention for realizing the first object noted above is a liquid jetting structure that, in a liquid jetting structure provided with nozzles for jetting a liquid, is characterized in that it comprises a nozzle (or nozzles) having a flow path wherein the degree of affinity for the liquid to be jetted is set so as to be different along the direction of liquid flow. The reason for this is that, when the degree of affinity for a liquid in a flow path is changed, the liquid separates from the surface of the flow path at that point of change and a significant point appears, and liquid droplets of uniform size are produced. This liquid jetting mechanism can be employed in all kinds of applications requiring uniform liquid droplets exhibiting good linearity of advance, such as in industrial manufacturing equipment, injectors and other medical equipment, and fuel injection apparatuses, in addition to nozzle components in ink jet recording heads.

By "liquid" here is meant not only ink, but any fluid exhibiting such viscosity that it can be jetted from a nozzle and used in industrial applications. This liquid may be either aqueous or oily. The liquid may also have prescribed mixture substances mixed therein in a colloidal form. By "degree of affinity" is meant a value that can be determined by the size of the angle with which a surface contacts a liquid. The affinity for a liquid is determined relatively by the angle of liquid contact relative to a plurality of areas. In a flow path, for example, areas having small contact angles with the liquid become areas of relatively high affinity, while areas s having large contact angles with the same liquid become areas of relatively low affinity. Whether or not affinity is exhibited for a liquid is determined relatively by the relationship between the molecular structure of the liquid and the molecular structure of the flow path surface. Thus if the liquid is changed, the degree of affinity also changes. In cases where the liquid contains a polar molecule such as water, for example, comparatively high affinity, i.e. a hydrophilic property, will be exhibited if the molecules configuring the flow path surface exhibit a polar structure. If the molecules configuring the flow path surface film have a nonpolar structure, comparatively low affinity, i.e. water repellency, will be exhibited. Conversely, in cases where the liquid is basically configured of nonpolar molecules, as in an organic solvent, comparatively low affinity will be exhibited when the molecules configuring the flow path surface have a polar structure, and comparatively high affinity will be exhibited when the molecules configuring the flow path surface have a nonpolar structure. Accordingly, there will be cases where a flow path surface that exhibits comparatively high affinity for one liquid will exhibit comparatively low affinity for another liquid.

The flow path considered here, in more specific terms, is formed by a molecular film that is present as a thiolate in which a prescribed sulfur compound has been coagulated on a metal surface.

The sulfur compound mentioned above may be configured, for example, of a thiol compound represented by the chemical formula R—SH where R is a hydrocarbon group. More specifically, if n, m, p, and q are any natural numbers, and X and Y are prescribed elements, then R may be represented by any of the following composition formulas, that is, by $C_nH_{2n+1}$—, $C_nF_{2n+1}$—, $C_nF_{2n+1}$—$C_mH_{2m}$—, $C_nF_{2n+1}$—$(CH_2)_m$—X—C≡C—C≡C—C—Y—$(CH_2)_p$—

$HO_2C(CH_2)_n$—, $HO(CH_2)_n$—, $NC(CH_2)_n$—, $H_{2n+1}C_n$—$O_2C$—$(CH_2)_m$—, $H_3CO(CH_2)_n$—, $X(CH_2)_n$—(where X is a halogen element such as Br, Cl, or I, etc.)

$H_2C{=}CH(CH_2)_n$—

$H_3C(CH_2)_n$—, or $C_nF_{2n+1}$—$(CH_2)_m$—(NHCO—$CH_2)_p$—$(CH_2)_q$—.

The sulfur compound mentioned above may also be configured of a thiol molecule mixture represented by the mutually differing chemical structural formulas $R^1$—SH and $R^2$—SH where $R^1$ and $R^2$ represent different hydrocarbon groups. More specifically, $R^1$ and $R^2$ are represented by one of the following chemical structural formulas, that is, by $C_nF_{2n+1}$— or $C_nF_{2n+1}$—$C_mH_{2m}$—.

Alternatively, the sulfur compound mentioned above may be configured of a thiol compound represented by the chemical structural formula HS—$R^3$—SH where $R^3$ is a prescribed hydrocarbon group. More specifically, $R^3$ may be represented by any of the following chemical structural formulas, namely by

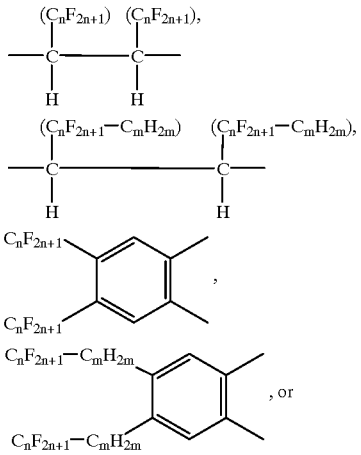

-continued

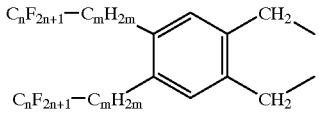

As another alternative, there are cases where, in the sulfur compound noted above, a thiol compound represented by the chemical structural formula $R^4$—S—S—$R^4$, where $R^4$ is a prescribed hydrocarbon group, is formed, either partially or wholly. More specifically, if n, m, p, and q are any natural numbers and X and Y are prescribed elements, then $R^4$ may be represented by any of the following chemical structural formulas, that is, by $C_nH_{2n+1}$—, $C_nF_{2n+1}$—, $C_nF_{2n+1}$—$C_mH_{2m}$—, $C_nF_{2n+1}$—$(CH_2)_m$—X—C≡C—C≡C—Y—$(CH_2)_p$—

$HO_2C(CH_2)_n$—, $HO(CH_2)_n$—, $NC(CH_2)_n$—, $H_{2n+1}C_n$—$O_2C$—$(CH_2)_m$—, $H_3CO(CH_2)_n$—, $X(CH_2)_n$—(where X is a halogen element such as Br, Cl, or I, etc.)

$H_2C{=}CH(CH_2)_n$—

$H_3C(CH_2)_n$—, or $C_nF_{2n+1}$—$(CH_2)_m$—(NHCO—$CH_2)_p$—$(CH_2)_q$—.

The flow path considered here is provided with a point of discontinuity where the degree of affinity for the liquid declines precipitously from the upstream end toward the downstream end.

This flow path, for example, is provided on the downstream end thereof with a region having a length of between 1 $\mu$ and 100 $\mu$ in which the degree of affinity for the liquid is relatively low.

In this flow path, furthermore, the degree of affinity for the liquid is set so that it gradually increases from the upstream end toward the downstream end thereof.

This flow path may also be provided on the downstream end thereof with a region wherein the degree of affinity for the liquid can be varied in response to changes in a physical quantity that is either heat, the strength of an electric field, or the strength of a magnetic field. When this is the case, means are also provided for supplying one of the physical quantities, that is, either heat, electric field strength, or magnetic field strength, in such manner that the quantity can be varied.

The jetting surface of the flow path noted above from which the liquid is jetted is set, for example, so that the degree of affinity for the liquid is relatively low.

Also, the inner surface of a reservoir for supplying the liquid to the flow path is set, for example, so that the degree of affinity for the liquid becomes relatively high.

The invention for achieving the second object noted earlier is an ink jet recording head that comprises the liquid jetting structure of the present invention. In terms of the jetting principle, a piezo jet mode, bubble jet mode, or static electric mode can be employed.

The invention for achieving the third object noted earlier is a printer comprising the ink jet recording head of the present invention.

BEST MODE FOR CARRYING OUT THE INVENTION

The best modes for carrying out the present invention are now described with reference to the drawings.

Embodiment 1

A first embodiment of the present invention relates to a liquid jetting structure wherein, in the flow path of the liquid jetting structure, a point of discontinuity is formed at which the degree of affinity for a liquid changes very rapidly.

Figure 9:
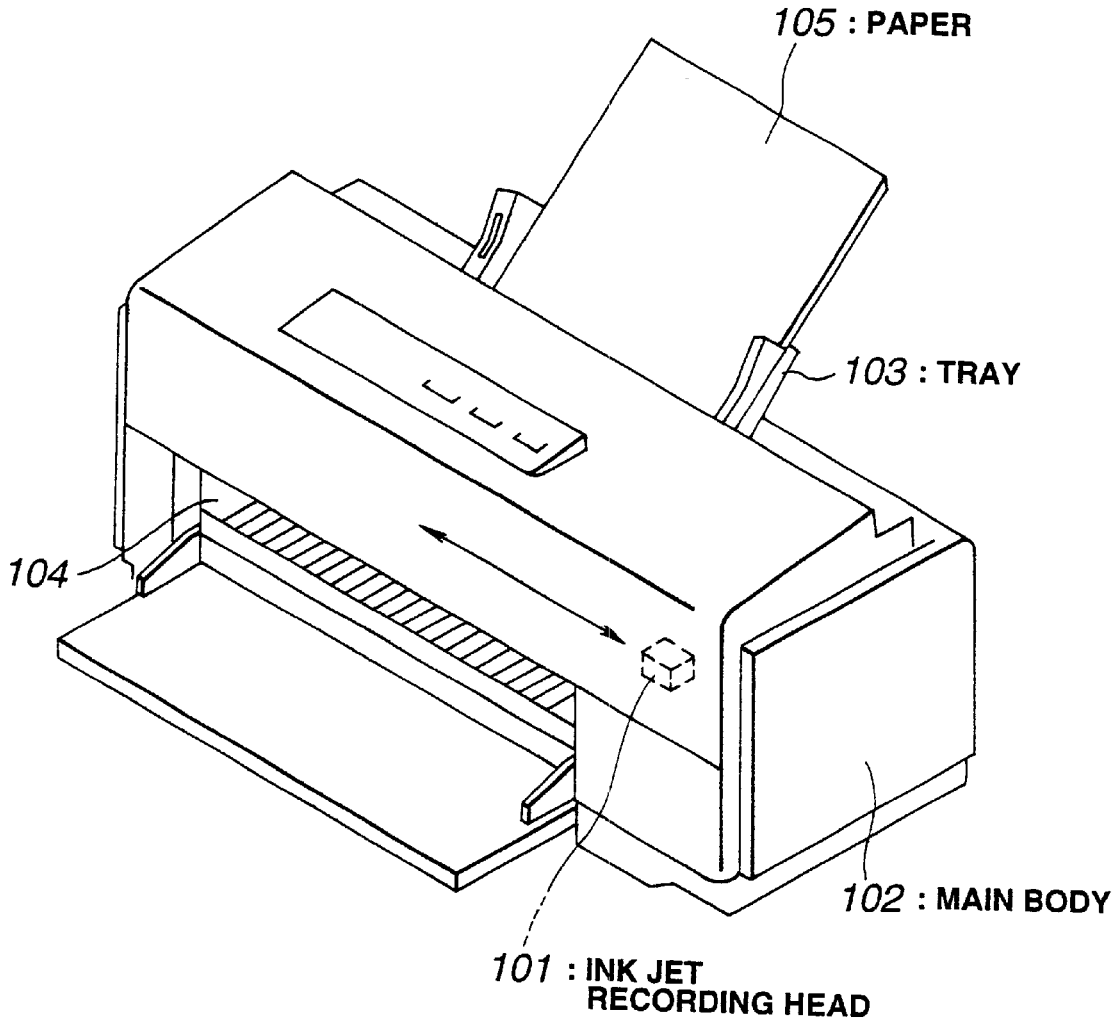
FIG. 9 is an overall diagonal view of a printer in an embodiment.

This embodiment employs the liquid jetting structure of the present invention in the nozzle component of an ink jet recording head used in an ink jet printer. Printing ink is used as the liquid. FIG. 9 provides a diagonal view of the ink jet printer in this embodiment. As diagrammed in FIG. 9, the ink jet printer 100 in this embodiment comprises an ink jet recording head 101 and a tray 103 and the like in a main body 102. Paper 104 is loaded in the tray 103. When print data are supplied from a computer (not shown), internal rollers (not shown) pull the paper 105 into the main body 102. When the paper 105 passes through the vicinity of the rollers, it is printed by the ink jet recording head 101 which is driven in the directions indicated by the double-headed arrow in the figure, and then ejected from an ejection slot 104. At this time, if the discharge of ink droplets from the ink jet recording head 101 is not performed accurately, the printing quality on the paper 105 will deteriorate, wherefore the liquid jetting structure of the present invention operates effectively.

When the liquid jetting structure of the present invention is employed in industrial applications, industrial-use solutions and solvents are used instead of ink, and the ink jet recording heads are used as liquid jetting means in manufacturing equipment.

Figure 10:
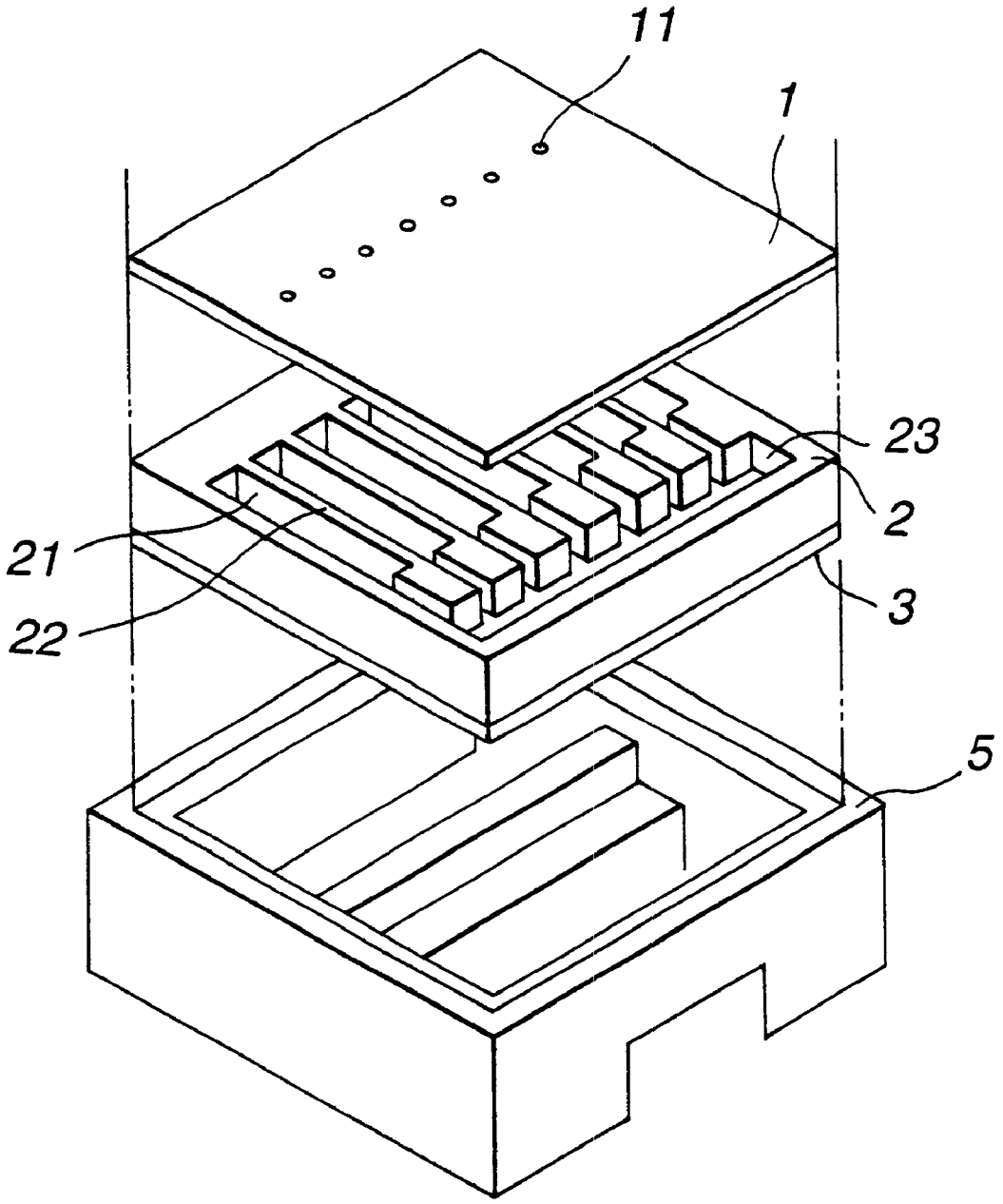
FIG. 10 is a diagonal diagram for explaining the structure of an ink jet recording head in an embodiment.
Figure 11:
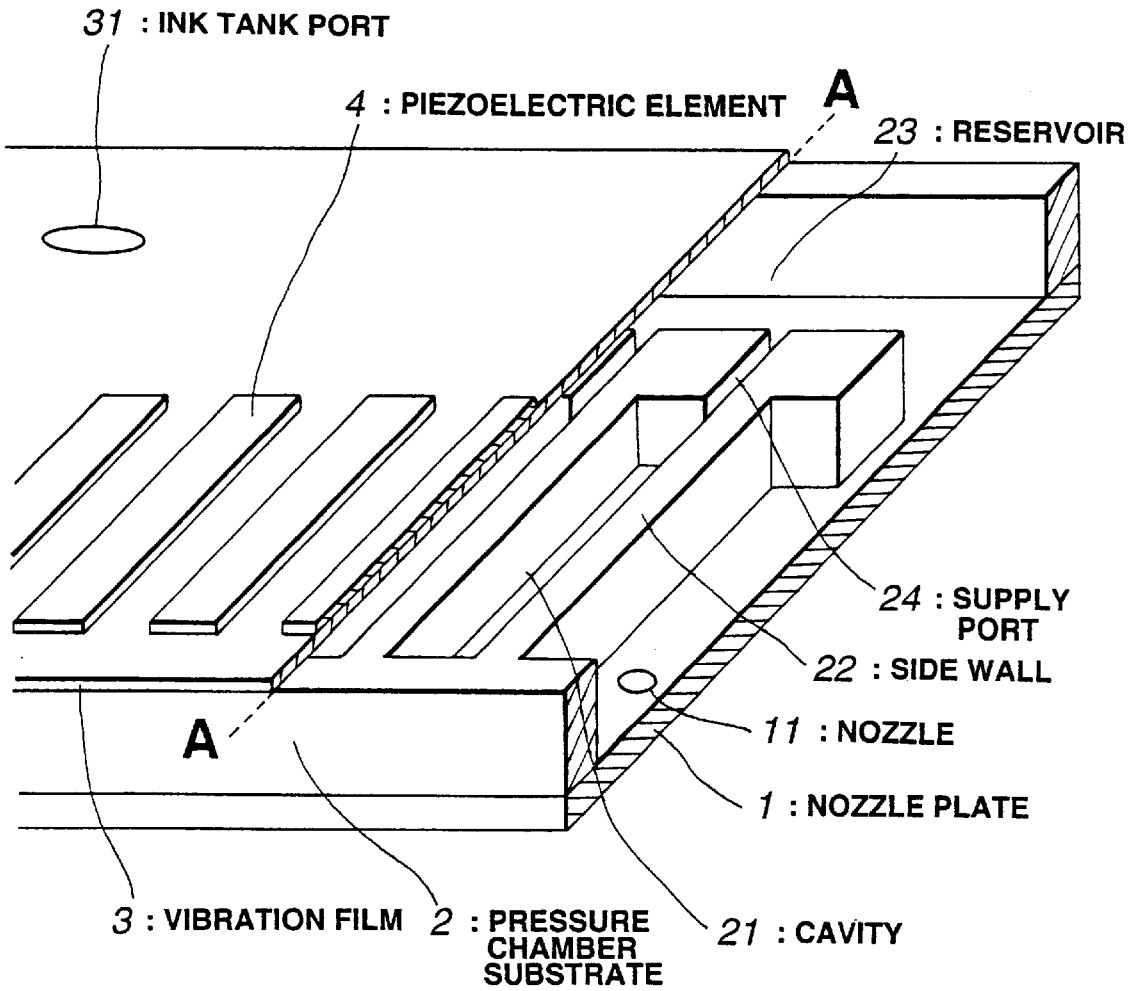
FIG. 11 is a diagonal view (and partial cross-sectional view) of the main components in an ink jet recording head in an embodiment.

FIG. 10 provides a diagonal diagram for describing the structure of the ink jet recording head in this embodiment. FIG. 11 provides a diagonal view and partial cross-sectional view of the structure of the main components in the ink jet recording head. This ink jet recording head 101 is configured with a nozzle plate 1 provided with nozzles 11 and a pressure chamber substrate 2 provided with a vibration film 3 that fit into a frame 5. The pressure chamber substrate 2 is sandwiched between the nozzle plate 1 and the vibration film 3.

The nozzle plate 1 has nozzles 11 formed therein in positions corresponding to cavities 21 when it is bonded together with the pressure chamber substrate 2. In these nozzles the liquid jetting structure to which the present invention pertains is employed, as will be explained in detail subsequently (cf. FIG. 1). The pressure chamber substrate 2 is provided with a plurality of cavities 21 that can each function as a pressure chamber, by etching a silicon monocrystalline substrate or the like. The cavities 21 are separated by side walls 22. Each cavity 21 is connected via a supply port 24 to reservoir 23 that constitutes a common flow path. The vibration film 3 is configured by a thermal oxidation film or the like, for example. Piezoelectric elements 4 are formed on the vibration film 3 at positions corresponding to the cavities 21. An ink tank port 31 is also provided in the vibration film 3, configured so that ink can be supplied from an ink tank (not shown). The piezoelectric elements 4 comprise a structure wherein, for example, PZT elements or the like are sandwiched between upper electrodes and lower electrodes (not shown).

The ink jet recording head of this embodiment, furthermore, has a reservoir for holding ink provided in the pressure chamber substrate 2, but the nozzle plate may also be implemented in a laminated structure with a reservoir provided in the interior thereof.

Figure 12:
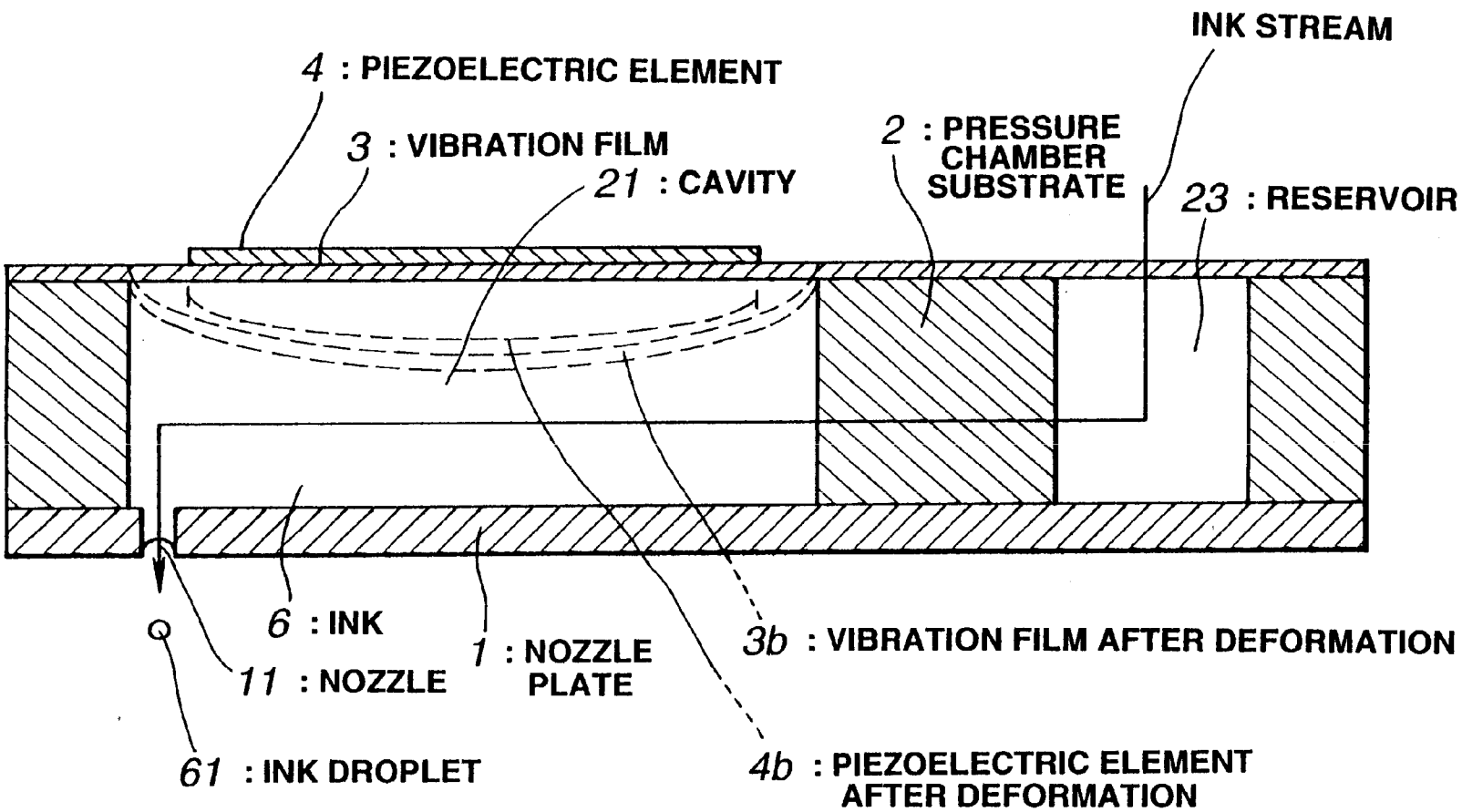
FIG. 12 is a diagram of the operating principle of an ink jet recording head.

The ink discharge principle based on the configuration of the ink jet recording head described above is now explained with reference to FIG. 12. FIG. 12 presents a cross-sectional view at the A—A line indicated in FIG. 11. Ink 6 is supplied to the reservoir 23 from the ink tank (not shown) via the ink tank port 31 provided in the vibration film 3. The ink 6 passes from this reservoir 23 through the supply port 24 into each cavity 21. When a voltage is applied across the upper electrode and the lower electrode of the piezoelectric element 4, the volume thereof changes. This change in volume deforms the vibration film 3, and changes the volume of the cavity 21.

The vibration film 3 is not deformed when no voltage is being applied. When a voltage is applied, however, the vibration film **3*b* and piezoelectric element 4*b* are deformed at positions indicated by the broken lines in FIG. 12. When the volume inside the cavity 21 changes, the pressure on the ink 6 filling the cavity 21 rises. Ink 6 is supplied to the nozzle 11, and an ink droplet 61 is jetted. At this time, the liquid jetting structure of the present invention is activated so that the ink droplet 61** exhibits a certain diameter, and so that it is jetted with a linear advance.

The nozzle plate may be formed integrally with the pressure chamber substrate. In that case, in FIG. 12, a blank silicon plate is etched, and shapes corresponding to the nozzle plate 1 and the pressure chamber substrate 2 are integrally formed. The nozzles are made after the etching.

Figure 1:
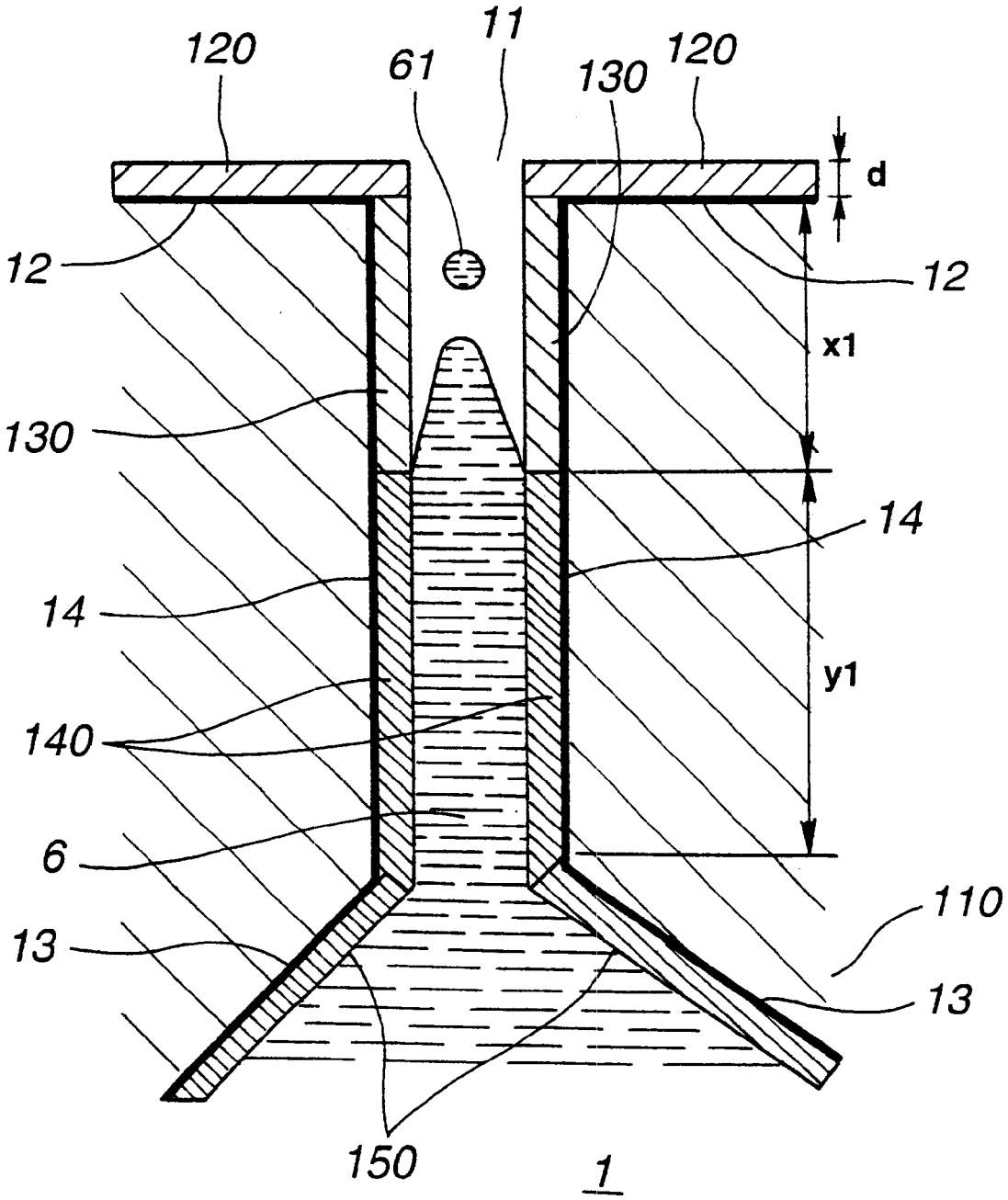
FIG. 1 is a cross-sectional diagram of the main components of a liquid jetting structure in a first embodiment.

FIG. 1 provides a cross-sectional view of the nozzle plate 1 in this embodiment, cut in the plane containing the nozzle 11. In this diagram, due to the drive of the pressure chamber substrate 4, ink is pushed up from below and discharged. In other words, the upper end of the nozzle 11 corresponds to the downstream portion of the flow path, while the lower end of the nozzle 11 corresponds to the upstream portion of the flow path. The nozzle plate 1 comprises regions 120, 130, 140, and 150 formed on the surface of a base 110 of a molecular film wherein thiol molecules are made to self-aggregate, thus making it possible to control the affinity for the ink.

The base 110 is made of a material exhibiting suitable hardness and elasticity for a nozzle plate, wherewith a metal film can easily be formed as the underlayer for the molecular film of the regions 120, 130, 140, and 150 that control the affinity. A metal, ceramic material, or resin, etc., can be used as this base material. Suitable metals include stainless alloys and nickel, etc. Suitable ceramic materials include silicone and zirconia, etc. Suitable resins include polyimides, polyphenylene sulfides, and polysulfones, etc. The thickness of the base 110 should be such as to provide adequate mechanical strength; if stainless steel, for example, this should be a thickness of 100 to 300 $\mu$m or more.

The nozzles 11 are formed such that they penetrate through the base 110 so that the flow path becomes cylindrical. The cross-sectional shape of the flow path, however, need not be circular, nor does the direction of the flow path need to be formed linearly. Instead of forming the nozzles as through holes in a uniform material such as the base, moreover, the nozzles may be flow paths formed between a plurality of materials. The overall length of each nozzle 11 should be such as to provide sufficient linearity of advance to the liquid, adjusted to such a length as will not overtax the piezoelectric element 4 because the flow path resistance is too high. The overall length of each nozzle 11 should be, for example, between 1 $\mu$m and 1000 $\mu$m or so. The hole diameter of the nozzles 11 is to be adjusted, depending on the viscosity of the liquid and the output of the piezoelectric element 4, etc., so that liquid droplets of the desired diameter are jetted. This diameter should be 30 $\mu$m or so, for example.

In each nozzle 11, the liquid jetting structure relating to the present invention is implemented by deploying, in order, in the direction of ink flow, on the inner walls 14 (hereinafter called "flow path walls") of the nozzles forming the flow path that penetrates both sides of the base 110, a region of relatively high affinity for the ink 6 that is the liquid and a film region of relatively low affinity therefor. In the downstream portion of the nozzle 11 a low-affinity region 130 is formed that exhibits relatively low affinity, while in the upstream portion thereof a high-affinity region 140 is formed that exhibits relatively high affinity. This high-affinity region 140 and low-affinity region 130 are deployed so as to form a point of discontinuity such as will very rapidly lower the affinity for the ink from the upstream end of the flow path to the downstream end thereof. Also, a low-affinity region 120 that exhibits relatively low affinity for the ink is formed on the surface 12 (hereinafter called the "outer surface") of the base 110 on which the liquid is jetted. And a high-affinity region 150 that exhibits relatively high affinity for the ink is formed on the surface (hereinafter called the "inner surface") of the base 110 on the cavity side. The low-affinity regions 120 and 130 exhibit a small degree of affinity for the ink, wherefore they are regions wherein the ink readily separates. The degree of affinity for the ink is high in the high-affinity regions 140 and 150, so those are regions wherein the ink readily adheres. The inner walls 13 in the base 110 may also be formed in a tapered shape in order to guide the ink toward the nozzle 11 without resistance.

The length x1 in the flow path direction of the nozzle 11 in the region where the low-affinity region 130 is formed is set so as to allow the ink to thoroughly separate from the flow path surface 14, at a length that is not so long as to impair the linearity of advance of the liquid droplets. Specifically, this should be $$1\ \mu m \leqq x1 \leqq 100\ \mu m,$$

but preferably $$10\ \mu m \leqq x1 \leqq 50\ \mu m.$$

Moreover, the length yl in the flow path direction of the nozzle 11 in the region where the high-affinity region 140 is formed is a length such that the linearity of advance of the liquid droplets can be definitely obtained, adjusted to a length that is not so long that it would increase the flow path resistance and overly tax the piezoelectric element 4. Specifically, this should be $$100\ \mu \leqq y1 \leqq 200\ \mu.$$

These regions for controlling affinity are formed by subjecting the base to surface treatments. It is particularly desirable that these regions be formed by self-aggregating molecular films. That is because a self-coagulating molecular film exhibits the desirable properties of having a film thickness d that is constant (2 nm or so) and that is resistant to wear. The self-aggregating molecular film is formed on a metal layer provided on the surface of the base by causing a sulfur compound to coagulate under specific conditions and fixed as a thiolate. The degree of affinity for the ink is determined by the type of sulfur compound that is made to coagulate on the surface of the metal layer.

For the metal layer that becomes the underlayer for coagulating the sulfur compound, gold (Au) is used because of its chemical and physical stability. Other metals capable of chemically adsorbing the sulfur compound may also be used, however, such as silver (Ag), copper (Cu), indium (In), and gallium-arsenic (Ga—As). A known technique such as wet plating, vacuum deposition, or vacuum sputtering can be used for forming the metal layer on the base. The type of method used is not limited so long as it is a film-forming method that can uniformly form a thin metal film of constant thickness. The function of the metal layer is to secure the sulfur compound layer, so the metal layer itself may be extremely thin. Thus, in general, the thickness may be on the order of 500 to 2000 Å.

In order to enhance the adhesiveness between the metal and the base 110, it is preferable that an intermediate layer be provided between the base and the metal. It is desirable that this intermediate layer be a material that strengthens the bonding force between the base 110 and the metal layer, such, for example, as nickel (Ni), chromium (Cr), tantalum (Ta), or an alloy (Ni—Cr, etc.) thereof. If an intermediate layer is provided, the bonding force between the base 110 and the metal layer increases, making it more difficult for the sulfur compound layer to peel away due to mechanical friction.

The self-aggregating molecular film is formed by dissolving the desired sulfur compound to make a solution and then immersing therein the nozzle plate 11 having a metal layer formed thereon. Sulfur compound, as used here, is a generic term for those organic compounds containing sulfur (S) that either contain one or more thiol functional groups or a disulfide (S—S) bond. These sulfur compounds are spontaneously chemically adsorbed to the surface of gold or other metals, either in solution or under volatile conditions, to form monomolecular films exhibiting a nearly two-dimensional crystalline structure. Such molecular films made by spontaneous chemical adsorption are called self-aggregating films, self-organizing films, or self-assembling films. Both basic research and application research are being done currently in this field. In this embodiment, gold (Au) is particularly in view, but self-aggregating films can also be formed in the same way on the surfaces of other metals as noted earlier.

For this sulfur compound, a thiol compound is preferable. Thiol compound, as used here, is a generic term for organic compounds having a mercapt group (—SH), represented as R—SH where R is an alkyl group or other hydrocarbon group. In general, most regions wherein a thiolate is formed using a sulfur compound having a hydrophilic polar group such as the OH group or $CO_2H$ group exhibit relatively high affinity for aqueous inks. Most regions wherein are formed thiolates using sulfur compounds having other, non-polar groups exhibit relatively low affinity for aqueous inks. However, the highness or lowness of the degree of affinity is a relative matter that is determined by which region exhibits the higher affinity for the liquid (ink) flowing through the flow path thereof. Accordingly, thiolates based on the same thiol compound will either form a high-affinity region exhibiting relatively high affinity for a liquid or a low-affinity region exhibiting relatively low affinity for a liquid depending on the combination with the other thiol compound used at the same time. The greater the difference in the degrees of affinity exhibited by the thiol compounds the better. In this embodiment, the thiol compounds that can be employed in the regions for controlling affinity can be selected from among the following items.

1) When R is a hydrocarbon group, a compound which is configured by a thiol compound represented by the chemical structural formula R—SH.

When this compound coagulates on a metal layer, elemental hydrogen is removed from the —SH groups and elemental sulfur bonds directly with the metal. In specific terms, if n, m, p, and q are any natural numbers, and X and Y are prescribed elements, then R will be represented by any of the following composition formulas, that is, by $C_nH_{2n+1}$—,
$C_nF_{2n+1}$—,
$C_nF_{2n+1}$—$C_mH_{2m}$—,
$C_nF_{2n+1}$—$(CH_2)_m$—X—C≡C—C≡C—Y—$(CH_2)_p$—
$HO_2C(CH_2)_n$—,
$HO(CH_2)_n$—,
$NC(CH_2)_n$—,
$H_{2n+1}C_n$—$O_2C$—$(CH_2)_m$—,
$H_3CO(CH_2)_n$—,
$X(CH_2)_n$—(where X is a halogen element such as Br, Cl, or I, etc.)
$H_2C{=}CH(CH_2)_n$—
$H_3C(CH_2)_n$—, or
$C_nF_{2n+1}$—$(CH_2)_m$—(NHCO—$CH_2)_p$—$(CH_2)_q$—.

2) A compound which is configured by a thiol molecule mixture represented by the mutually differing chemical structural formulas $R^1$—SH and $R^2$—SH where $R^1$ and $R^2$ represent different hydrocarbon groups.

When this compound coagulates on a metal layer, elemental hydrogen is removed from the —SH groups, and elemental sulfur bonds directly to the metal. This results in a mixture of two types of thiolate. In specific terms, $R^1$ and $R^2$ are represented by one of the following chemical structural formulas, that is, by $C_nF_{2n+1}$— or $C_nF_{2n+1}$—$C_mH_{2m}$—.

3) A compound which is configured of a thiol compound represented by the chemical structural formula HS—$R^3$—SH where $R^3$ is a prescribed hydrocarbon group.

When this compound coagulates on a metal layer, elemental hydrogen is removed from the —SH groups and elemental sulfur bonds directly with the metal. In specific terms, $R^3$ may be represented by any of the following chemical structural formulas, namely by

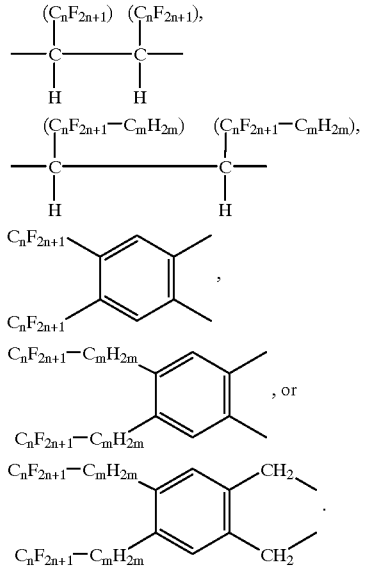

4) That wherein is formed, either partially or wholly, a thiol compound represented by the chemical structural formula $R_4$—S—S—$R^4$, where $R^4$ is a prescribed hydrocarbon group.

When this compound coagulates on a metal layer, the covalent bonds between the sulfur atoms are removed, either partially or wholly, and some of the elemental sulfur bonds directly with the metal. In specific terms, if n, m, p, and q are any natural numbers and X and Y are prescribed elements, then $R^4$ will be represented by any of the following chemical structural formulas, that is, by $C_nH_{2n+1}$—,
$C_nF_{2n+1}$—,
$C_nF_{2n+1}$—$C_mH_{2m}$—,
$C_nF_{2n+1}$—$(CH_2)_m$—X—C≡C—C≡C—Y—$(CH_2)_p$—
$HO_2C(CH_2)_n$—,
$HO(CH_2)_n$—,
$NC(CH_2)_n$—,
$H_{2n+1}C_n$—$O_2C$—$(CH_2)_m$—,
$H_3CO(CH_2)_n$—,
$X(CH_2)_n$—(where X is a halogen element such as Br, Cl, or I, etc.)
$H_2C{=}CH(CH_2)_n$—
$H_3C(CH_2)_n$—, or
$C_nF_{2n+1}$—$(CH_2)_m$—(NHCO—$CH_2)_p$—$(CH_2)_q$—.

Instead of forming a single self-aggregating molecular film in the entire region of the flow path as a region for controlling affinity, a pattern may be formed with regions provided with a self-aggregating molecular film and regions not so provided. When such a configuration is implemented, the affinity of the regions can be adjusted by altering the area ratio between regions provided with the molecular film and regions not so provided.

In FIG. 5 is explained the principle of self-aggregation when the sulfur compound is a thiol compound. As diagrammed in FIG. 5A, the thiol compound has tail portions configured by mercapt groups. This compound is dissolved in a 1–10 mM ethanol solution. Into that solution is immersed the gold film, as diagrammed in FIG. 5B. When this is allowed to stand for 1 hour or so at room temperature, the thiol compound spontaneously aggregates on the surface of the gold. The gold atoms and the sulfur atoms are bonded with covalent bonds, and a molecular film of thiol molecules is formed two-dimensionally on the surface of the gold (cf. FIG. 5D). The thickness of so this film depends on the molecular weight of the sulfur compound, but it will be on the order of 10–50 Å. In some cases the film will be formed as a two-dimensional array of single molecules, and in others it will be formed by a two-dimensional arrangement of a plurality of molecules where is another compound reacts with groups of single molecules arrayed two-dimensionally.

(Action)

Figure 2A:
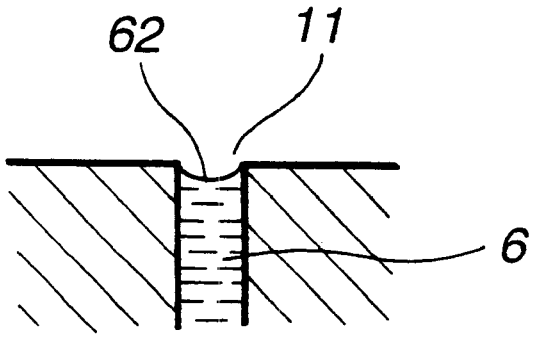
FIG. 2 is a set of diagrams for explaining how ink is jetted from a conventional liquid jetting structure.
Figure 2B:
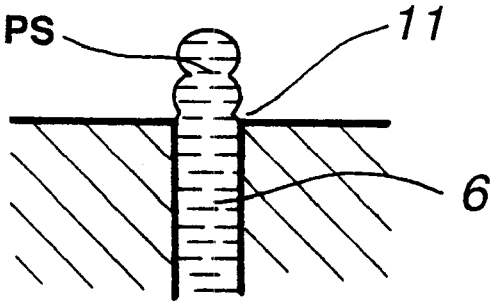
Figure 2C:
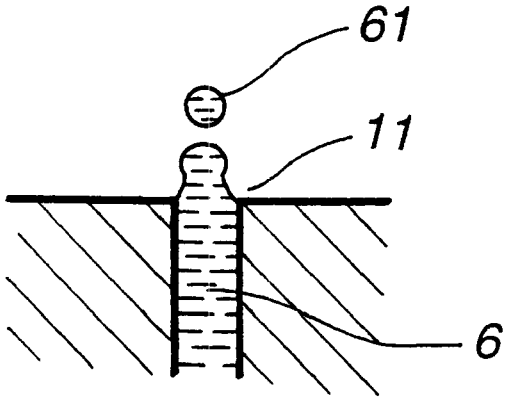

FIG. 2 is provided for explaining the problems encountered in discharging liquid droplets from an ink jet recording head when a conventional nozzle plate is used. When the piezoelectric element is in the steady state wherein no volumetric change is occurring, a meniscus 62 develops at the edge of the nozzle 11 due to the surface tension of the ink 6 (cf. FIG. 2A). When the piezoelectric element is driven and a volumetric change occurs in the cavity, ink is forced out from the nozzle 11. The ink 6 propelled out from the nozzle exhibits a constriction at a significant point PS produced by the surface tension balance (cf. FIG. 2B). The constriction occurring at the significant point PS grows larger due to the action of surface tension. The pillar of the ink 6 finally separates at its tip, whereupon the liquid droplet 61 is jetted out (cf. FIG. 2C).

When a liquid is jetted from a conventional nozzle plate, the positions where the significant points develop, because of the development of significant points due to surface tension balance, is not constant. The size of the liquid droplets 61 jetted out depends on the position where the significant point PS occurs, so the diameter thereof is not constant either. Furthermore, when the outer surface of the nozzle plate has not been subjected to a water repellent treatment, the pillar of ink shooting out of the nozzle 11 is bent by surface tension, whereupon the direction in which the liquid droplets 61 are jetted is also bent.

Figure 3A:
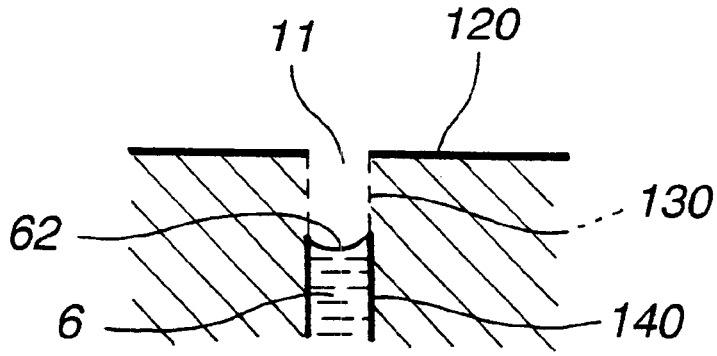
FIG. 3 is a set of diagrams for explaining the principle of ink jetting from the liquid jetting structure of the present invention.
Figure 3B:
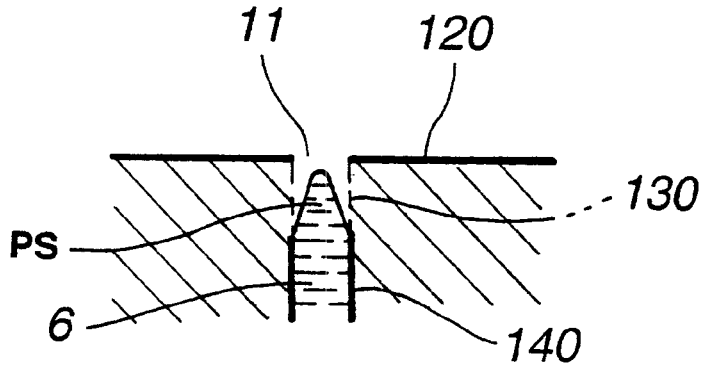
Figure 3C:
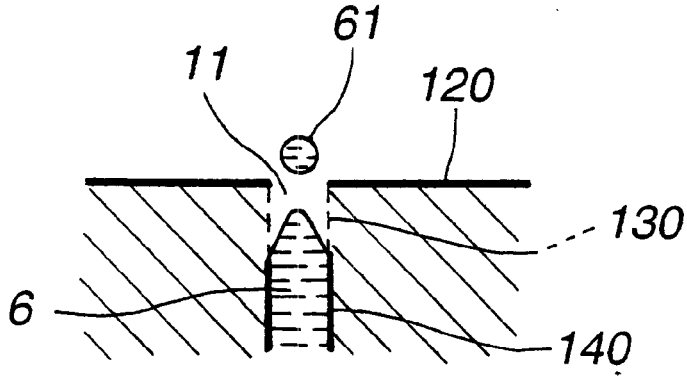
Figure 4A:
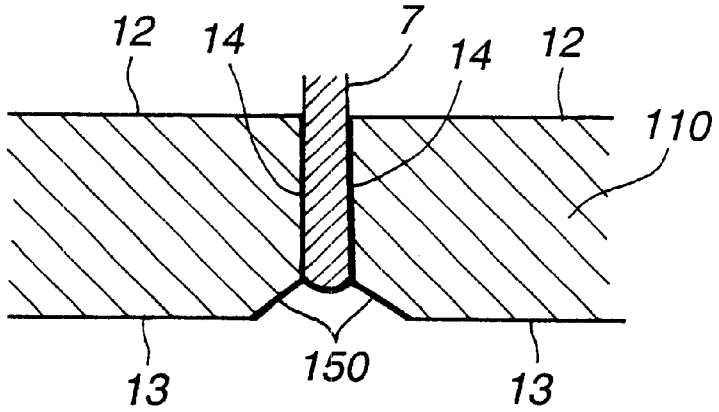
FIG. 4 is a set of cross-sectional diagrams of the fabrication processes for the liquid jetting structure of the first embodiment.
Figure 4B:
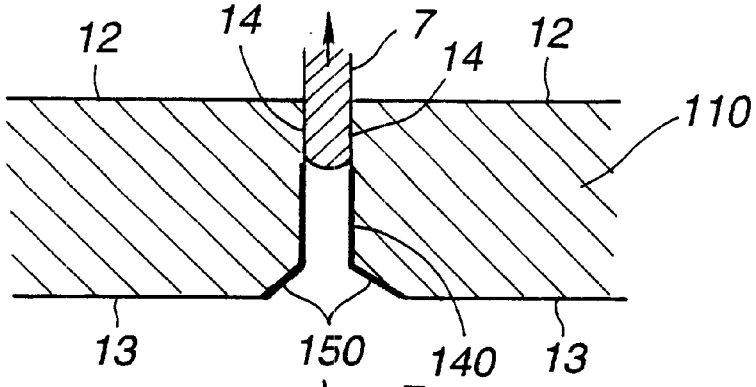
Figure 4C:
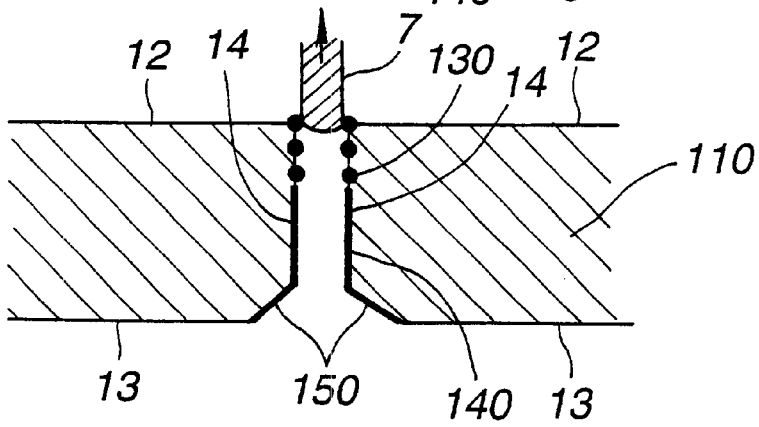
Figure 4D:
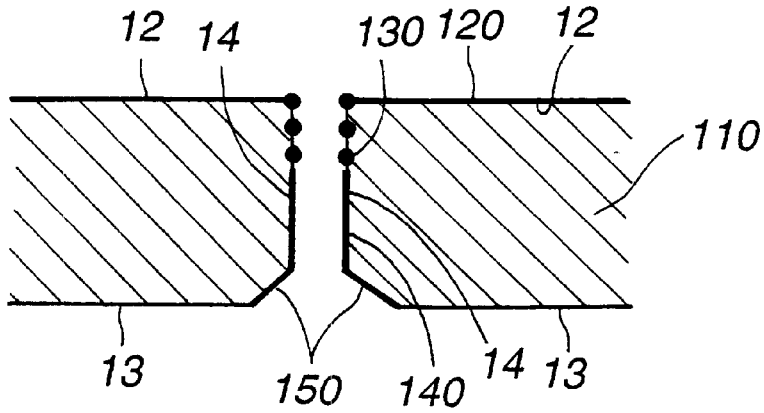
Figure 5A:
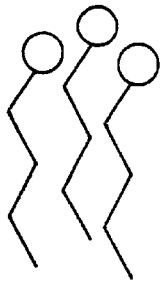
FIG. 5 is a set of diagrams for explaining self-accumulation in a thiol compound.
Figure 5B:
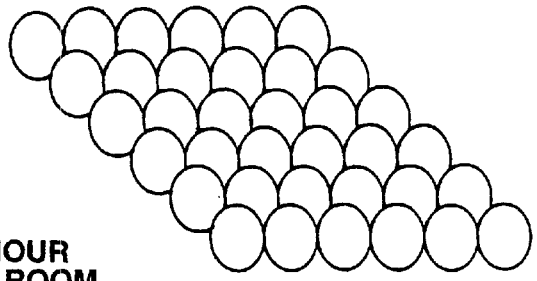
Figure 5C:
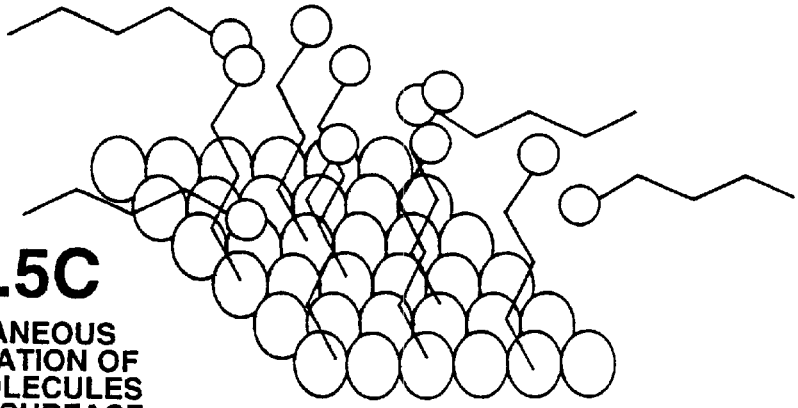
Figure 5D:
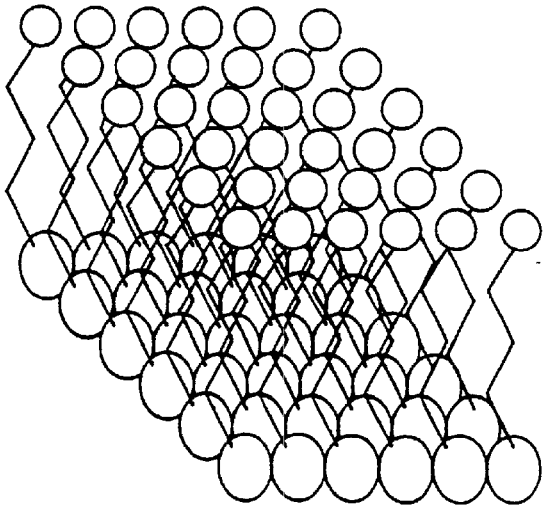

In FIG. 3 is diagrammed the way that liquid drops are discharged from an ink jet recording head when the nozzle plate of the present invention is employed. When the piezoelectric element is in a steady state wherein no volumetric change is occurring, the ink 6 does not cling to the low-affinity region 130. For this reason, a meniscus 62 develops due to the surface tension of the ink 6 at the point of discontinuity that is the point where the high-affinity region 140 and the low-affinity region 130 are joined (cf. FIG. 3A). When the piezoelectric element 4 is driven and a volumetric change is produced in the cavity 21, the ink 6 is forced out. The low-affinity region 130 causes the ink 6 to retract, wherefore the ink 6 pillar grows from the interface between the low-affinity region 130 and the high-affinity region 140. The ink 6 adheres to the high-affinity region 140 but separates from the low-affinity region 130. The ink will be pushed relatively toward the inside of the nozzle 11, wherefore a constriction will always occur at the significant point that is at a constant distance from the point of affinity discontinuation that is the interface between the high-affinity region 140 and the low-affinity region 130 (cf. FIG. 3B). Once a constriction develops, that constriction grows irreversibly, and the tip portion of the ink 6 pillar is discharged from the nozzle as a liquid droplet 61 (cf. FIG. 3C).

When the nozzle plate of the present invention is implemented, the significant point always develops at a specific position, wherefore the diameter of the ink droplets 61 discharged will be nearly constant. Furthermore, if the point of discontinuity between the high-affinity region 140 and the low-affinity region 130 is formed in a plane that is parallel to the outer surface of the nozzle plate, no unbalanced surface tension will act on the ink pillar, wherefore the liquid droplets 61 will be discharged along a line of direction that is an extension of the nozzle 11.

(Manufacturing Method)

A preferred embodiment of a manufacturing method for the ink jet recording head in this embodiment is now described with reference to FIG. 4.

Nozzle plate forming process: A 100 $\mu$m or so stainless plate, according to the JIS standard (SUS), is used as the base 110. In this is bored a nozzle having a diameter of 20–40 $\mu$m, using prior art. The end of the nozzle 11 with the smaller diameter is put at the outer surface 12 of the nozzle plate 1. The outer surface of the nozzle plate is made smooth in order to apply a surface modifying film. The surface roughness of the outer surface is made on the order of 100 Å in terms of centerline average height.

Metal layer forming process: A metal layer is formed on the inner surface 13, outer surface 12, and flow path surface 14 of the base 110. A metal layer having a thickness of 500–2000 Å, for example, is formed, by either a vacuum sputtering or ion plating method. When an intermediate layer is to be formed beneath the metal layer, Cr, for example, is formed to a thickness of 100–300 Å as the intermediate layer either by vacuum sputtering or ion plating.

Inner surface modifying film formation process (cf. FIG. 4A): An affinity film 150 that is a surface modifying film is formed on the inner surface 13 of the nozzle plate 1. First, a masking rod 7 of a size that fits tightly in the nozzle 11 is inserted in the nozzle 11, and only the region wherein is formed the high-affinity region 150 is exposed. Although not shown in the drawings, a mask may be applied to the entire surface of the outer surface 12 of the nozzle plate. Next, a thiol compound is selected from the compositions noted earlier for forming the thiolate in the high-affinity region 150, and a solution is used which has that thiol compound dissolved in an organic solvent such as ethanol or isopropyl alcohol. Then one side of the nozzle plate on which the metal layer is formed is immersed in this solution. The immersion conditions are a thiol compound concentration in the solution of 0.01 mM, a solution temperature of from room temperature to 50° C. or so, and an immersion time of from 5 minutes to 30 minutes or so. The solution is either stirred or circulated during the immersion process to form the thiol compound layer uniformly.

If the purity of the metal surface can be maintained, the thiol molecules exhibit self-aggregation to form a molecular film, wherefore rigorous condition control is not required. About the time that the immersion is finished, a molecular film of thiol molecules that exhibits strong adhesion will be formed, only on the surface of the metal.

Next, the solution liquid on the surface of the nozzle plate is removed by washing. Thiol molecules adhering to portions other than the metal are not covalent bonded so they can be easily removed washing, such as by rinsing with ethyl alcohol.

Process of forming high-affinity region on flow path surface (cf. FIG. 4B): In this process, the high-affinity region 140 is formed on the flow path surface 14. The masking rod 7 noted above is retracted until the region where the high-affinity region 140 is to be formed is exposed. Then the thiol compound (such as $HO_2C(CH_2)_nSH$ or $HO(CH_2)_nSH$, etc.) for forming the thiolate in the hiqh-affinity region 140 is selected, and a solution is used wherein this thiol compound has been dissolved in an organic solvent such as ethanol or isopropyl alcohol. Immersion and washing are performed as in the process described above.

In this process, the high-affinity region 140 is formed in the region where the metal is exposed. The region 150 where the self-aggregating molecular film has already been formed, even if further immersed in the solution containing a thiol compound, will not exhibit film composition alteration or film growth, wherefore no measure such as deploying a mask in that region is necessary.

Process of forming low-affinity region on flow path surface (cf. FIG. 4C): In this process, the low-affinity region 130 is formed on the flow path surface 14. The masking rod 7 noted earlier is retracted until the region where the low-affinity region 130 is to be formed is exposed. When a mask is deployed on the outer surface 12 of the nozzle plate, the masking rod may be removed entirely. Next, a thiol compound (such as $CF_3(CF_2)_m(CH_2)_nSH$, etc.) for forming the thiolate in the low-affinity region 130 is selected, and a solution is used wherein this thiol compound has been dissolved in an organic solvent such as ethanol or isopropyl alcohol. Immersion and washing are performed as in the process described above.

In this process, the low-affinity region 130 is formed in the region where the metal is exposed. The regions 150 and 140 where the self-aggregating molecular films have already been formed, even if further immersed in the solution containing a thiol compound, will not exhibit film composition alteration or film growth, wherefore no measure such as deploying a mask in those regions is necessary.

Process of forming low-affinity region on outer surface (cf. FIG. 4D): In this process, the low-affinity region 120 is formed on the outer sur face 12 of the nozzle plate. All masks are removed and the outer surface 12 of the nozzle plate is exposed. Next, a thiol compound is selected for forming the thiolate in this low-affinity region 120, and a solution is used wherein this thiol compound has been dissolved in an organic solvent such as ethanol or isopropyl alcohol. Immersion and washing are performed as in the process described above.

In this process, the low-affinity region 120 is formed on the outer surface 12 of the nozzle plate. The regions 150, 140, and 130 where the self-aggregating molecular films have already been formed, even if further immersed in the solution containing a thiol compound, will not exhibit film composition alteration or film growth, wherefore no measure such as deploying a mask in those regions is necessary.

As based on this first embodiment, a region is formed on the outer surface side of the nozzle plate that exhibits relatively low affinity for the ink, and a region is formed on the inner surface side of the nozzle plate that exhibits relatively high affinity for the ink, wherefore an ink droplet constriction will develop from the point of discontinuity between the two regions, and ink will separate at a prescribed distance therefrom and become a liquid droplet having a certain diameter.

Accordingly, the significant point for producing the liquid droplets can be caused to stably emerge, wherefore the diameter of the ink droplets discharged can be stabilized.

Also, the linearity of advance of the liquid droplets will not be impaired by the bias of the surface tension when the ink is discharged. Hence print quality in the printer can be improved. By changing the ink to a liquid having industrial applications, furthermore, this ink jet recording head can be used in industrial applications.

Embodiment 2

A second embodiment of the present invention relates to a configuration wherewith, in the nozzle in the first embodiment described in the foregoing, the fluid resistance in the flow path can be lowered.

(Configuration)

Figure 6:
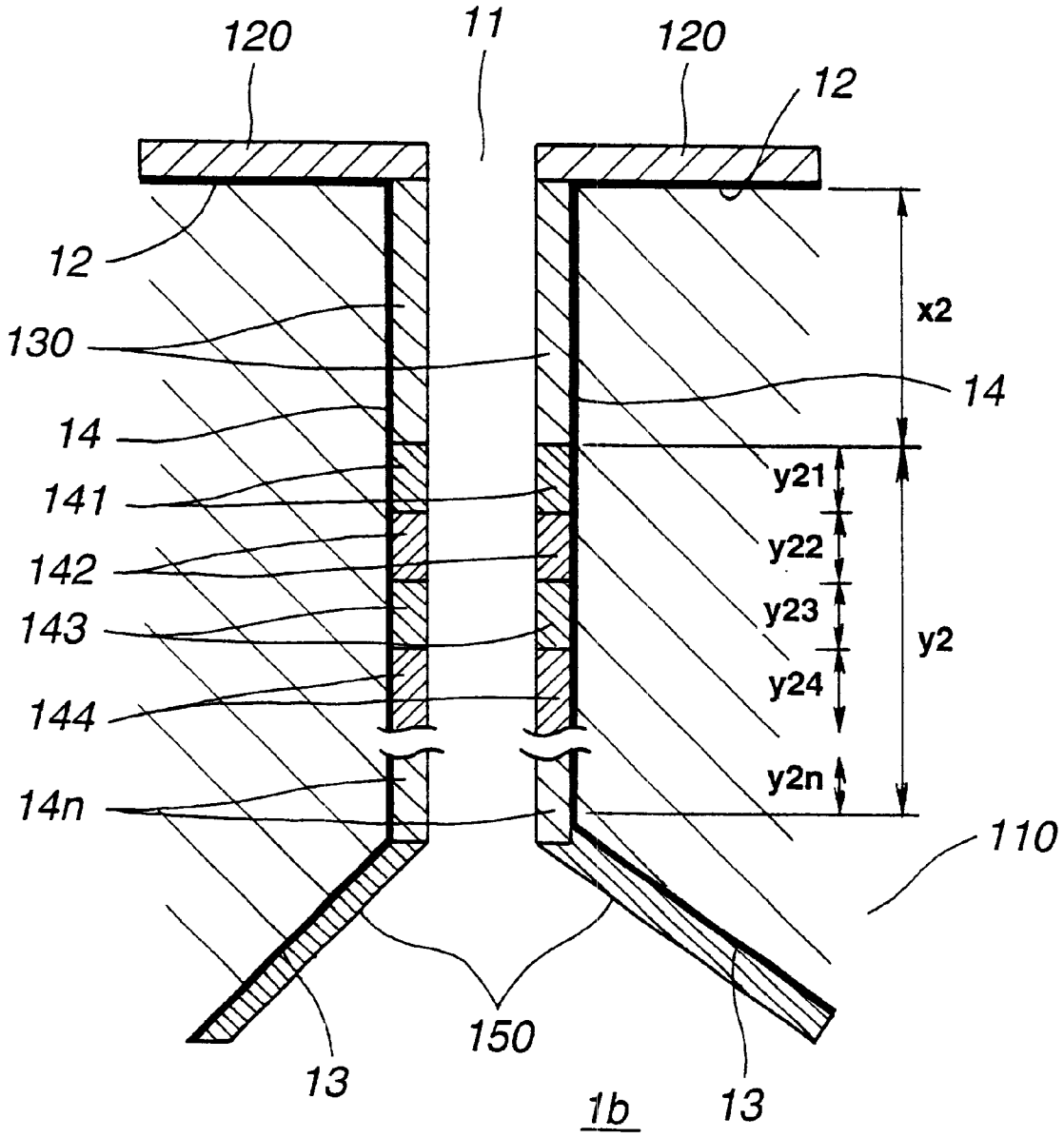
FIG. 6 is a cross-sectional diagram of the main components of a liquid jetting structure in a second embodiment.

FIG. 6 is a cross-sectional view of a nozzle plate 1*b* in the second embodiment. This nozzle plate 1*b* has a plurality of regions 141–14n (where n is a natural number 2 or greater) that exhibit different affinities for ink deployed in the region where the high-affinity region 140 is formed in the first embodiment described above. In the flow path surface 14, the low-affinity region 130 exhibiting relatively low affinity for the ink, the low-affinity region 120 formed on the outer surface, and the high-affinity region 150 formed on the inner surface are the same as in the first embodiment, and hence are not further described here.

It is also permissible to extend the affinity regions 141–14n to the edge on the outer surface 12 side of the nozzle 11, without forming the low-affinity region 130 (representing the case where the length x2 of the low-affinity region 130 in the flow path direction is zero).

Each of the several affinity regions 141–14n is set so as to exhibit mutually different degrees of affinity. If we represent these degrees of affinity of the affinity regions 141–14n by N1–Nn, then they are set such that $$N1>N2>N3>\ldots>Nn-1>Nn. \quad (1)$$

It is desirable that the several affinity regions 141–14n be formed by self-aggregating molecular films as in the first embodiment described earlier. The compositions of the sulfur compounds used in forming the self-aggregating molecular films are given in Table 1 below for the case where the number of affinity regions provided is four (n=4).

TABLE 1

| Affinity Region | Sulfur Compound Composition |
|---|---|
| 141 | $HO(CH_2)_{11}SH$ |
| 142 | $H_3CO(CH_2)_{11}SH$ |
| 143 | $H_3C(CH_2)_{17}SH$ |
| 144 | $F(CF_2)_{10}(CH_2)_{11}SH$ |

The method of fabricating the affinity regions in the nozzle 11 follows the first embodiment described earlier. More specifically, with reference to FIG. 4, when fabricating the affinity regions 141–14n, the masking rod 7 is retracted so that only that region were thiolate is to be newly formed is exposed, and, every time that is done, the nozzle plate is immersed in a solution wherein a different type of sulfur compound has been dissolved. This process is repeated a number of times equal to the number of affinity regions to be formed. The lengths y21–y2n of the several affinity regions 141–14n along the extension line of the nozzle 11 need only be about 1 $\mu$ or so each.

In order to set each affinity region to the desired degree of affinity, it is also permissible, instead of changing the compositions of the sulfur compounds used in forming each region as described above, to make adjustments by changing the pattern. That is, while using the same composition for the sulfur compound, the portion in each of the affinity regions where the thiolate is formed is made in a different pattern, and the molecular film contact surface is changed affinity region by affinity region. When the affinity regions are configured in this way, the degree of affinity in each affinity region can be changed according to the difference in the area ratio between the region where the molecular film is deployed and the region where the molecular film is not deployed. It is also permissible to use patterning to form an affinity region wherein the degree of affinity changes continuously. Instead of separating the affinity regions 141–14n as described above, in other words, a continuous pattern (such as a spiral pattern, for example) is employed, and the region is formed so that the ratio of the region occupied by the pattern gradually changes. If such a configuration as this is adopted, instead of the degree of affinity changing stepwise in the flow path direction, the degree of affinity changes continuously.

(Action)

As based on this configuration, when the ink flows from the upstream to the downstream end of the nozzle 11, the degree of affinity gradually rises. Once the ink inters into the flow path of the nozzle 11, surface tension acts strongly with the region or regions of higher affinity, wherefore the ink will be pulled to the downstream affinity region or regions exhibiting high affinity. In other words, the ink that enters the nozzle 11 is acted on by forces to move it, according to the degrees of affinity for the ink, from the affinity region 14n exhibiting relatively low affinity toward the affinity region 141 exhibiting relatively high affinity. Thus the ink will move spontaneously through the interior of the flow path. For this reason, when a pressure is applied from the piezoelectric element, the ink will move through the inside of the nozzle faster than in a conventional nozzle. This means that the flow path resistance of the ink passing through the nozzle 11 has declined. That being so, the ink can be led into the flow path with little load on the piezoelectric element 4, so that the same quantity of ink droplets can be discharged with less power.

The higher the speed of the liquid, the more definitely will the significant point be generated for separating the liquid droplets. If a low-affinity region 130 like that described in the first embodiment is placed downstream in the flow path to provide a point of discontinuity where the degree of affinity rapidly changes, the ink that moves quickly with low flow path resistance will separate from the flow path surface at the low-affinity region 130 and produce a significant point. That being so, it is possible to stably produce a significant point for producing liquid droplets, to stabilize the diameter of the liquid droplets, and to secure the linearity of advance of the ink droplets discharged.

As based on the second embodiment described in the foregoing, an affinity region is provided such that the degree of affinity changes in the direction of ink flow, thereby making it possible to lower the flow path resistance of the ink in the flow path, and the ink can be discharged with a low load.

If a point of discontinuity in the degree of affinity is formed in the first embodiment, moreover, a significant point for producing ink droplets can be stably produced, the ink droplet diameter can be stabilized, and the linearity of advance of the ink droplets discharged can be secured. That being so, the print quality in the printer can be improved. By changing the ink to a liquid having industrial applications, moreover, this ink jet recording head can be employed in industrial applications.

Embodiment 3

A third embodiment pertains to a configuration wherein, in the nozzle in the first embodiment described earlier, the degree of affinity in the flow path is changed dynamically.

(Configuration)

Figure 7:
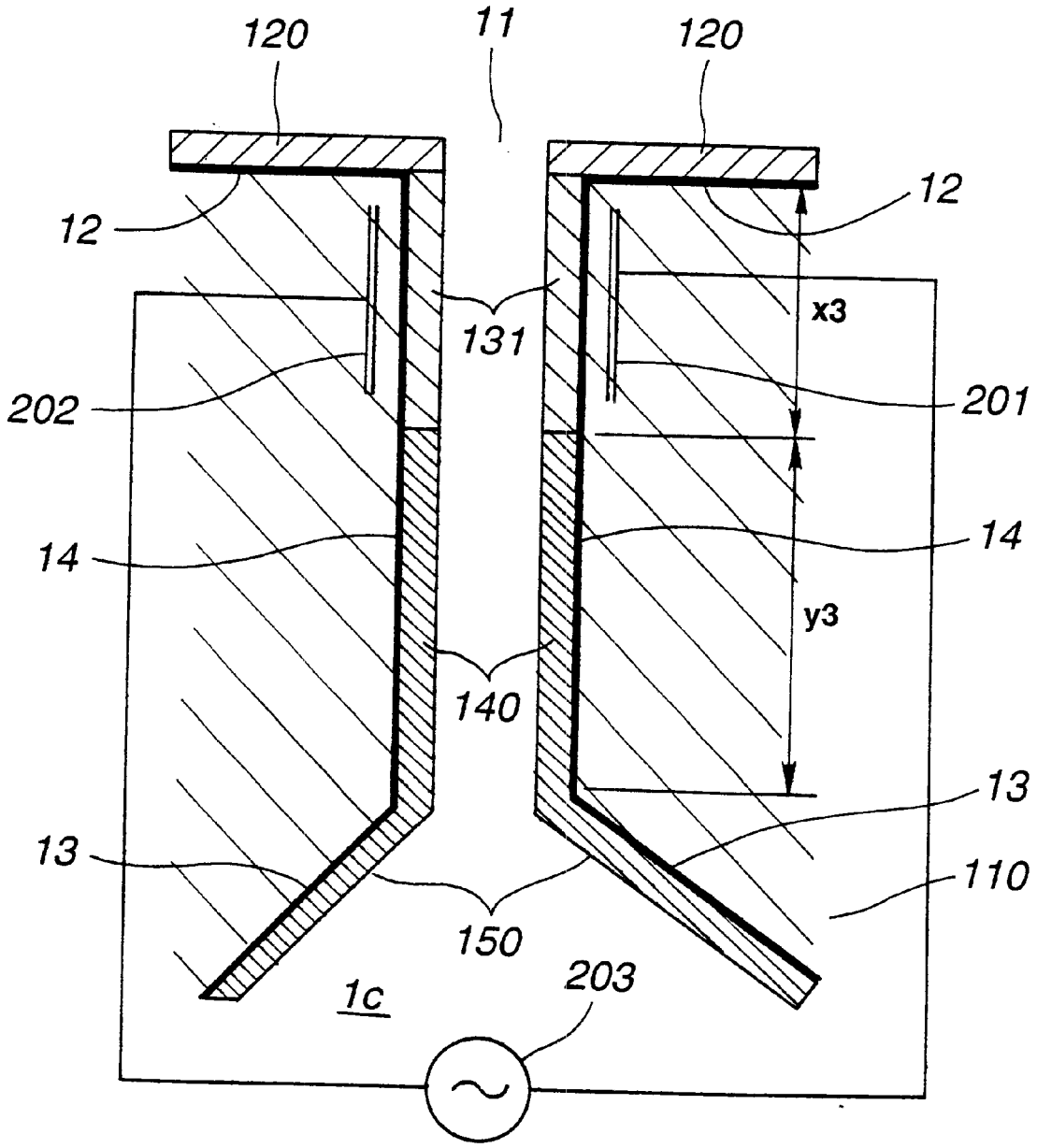
FIG. 7 is a cross-sectional diagram of the main components of a liquid jetting structure in a third embodiment.

FIG. 7 is a cross-sectional view of a nozzle plate 1*c* in the third embodiment. Instead of the low-affinity region 130 in the first embodiment, this nozzle plate 1*c* comprises an affinity region 131 wherewith the degree of affinity for the ink can be changed dynamically. A low-affinity region 120 exhibiting relatively low affinity for the ink, and high-affinity regions 140 and 150 exhibiting relatively high affinity for the ink are the same as in the first embodiment and so are not described further here.

The nozzle plate 1*c* also comprises electrodes 201 and 202 on the back side of the affinity region 131 in the base 110, and a drive circuit 203 is provided for applying voltages across these two electrodes. The drive circuit 203 is configured so that it can output drive signals that indicate the same voltage changes as the drive pulses applied to the piezoelectric element 4. However, in view of the delay from the time that the piezoelectric element exhibits a volumetric change to the time that the ink enters the nozzle 11, the drive signals are delayed so as to lag the drive pulses.

Figure 8:
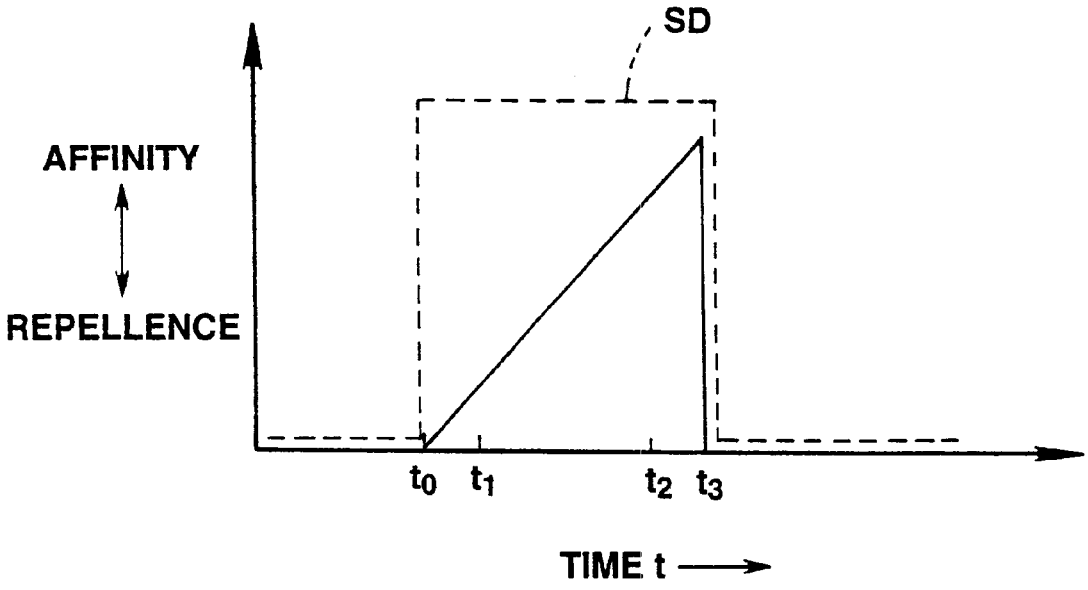
FIG. 8 is a diagram for explaining the drive characteristics of a low-affinity region in the third embodiment.

The affinity region 131 is made of a material wherewith the affinity for the ink changes in response to an electric field. This material is to be such that, as diagrammed in FIG. 8, for example, the degree of affinity is changed by the drive signal SD (broken line). The timing relationship between the drive signal and the alterations in the degree of affinity is an empirical relationship because it changes according to the amount of the delay mentioned above. The degree of affinity variation characteristics need not be limited to those plotted in FIG. 8, however, and can be variously modified in actual applications.

In this embodiment, a composition is used wherewith the degree of affinity is changed by an electric field. However, the affinity region may also be controlled by varying another physical quantity such as a magnetic field or heat applied to the affinity region 131.

(Action)

As based on the configuration described above, it is possible to dynamically change the degree of affinity of the affinity region, wherefore the effectiveness manifested corresponds to the dynamic changes in the degree of affinity. When the degree of affinity is varied in the affinity region 131 with characteristics like those plotted in FIG. 8, for example, the ink reaches the interface between the high-affinity region 140 and the affinity region 131 in the vicinity of time t0, and the significant point appears at time t1. When the significant point appears, the constriction in the ink pillar becomes larger. When the affinity increases in the affinity region 131 as time advances, the ink starts adhering to the affinity region 131 also, which accelerates the growth of the constriction. At time t2, the ink separates at the significant point and becomes a liquid droplet. After that, at time t3, when the affinity region 131 again becomes such that it does not exhibit affinity, the ink that was adhering to the affinity region 131 returns to the interface between the high-affinity region 140 and the affinity region 131. By dynamically varying the degree of affinity for the ink in the affinity region, ink droplets can be separated more quickly, and constrictions can be stably produced at a specific significant point.

By implementing this third embodiment, affinity control means are provided which can dynamically alter the degree of affinity for the ink, wherefore it is possible to stably produce significant points for producing liquid droplets, and to quickly separate the liquid droplets. Thus the quantity of ink droplets discharged can be even more constantly stabilized.

(Other Modifications)

The present invention can be applied in various modified forms other than the embodiments described in the foregoing. For example, although ink (aqueous ink) is used as the liquid in the embodiments described above, when an ink jet recording head is used in an industrial application, other solutions, solvents, and liquids can be used, whether aqueous or oily, instead of ink. These liquids may also have mixtures mixed therein in colloidal form. When an organic solvent is employed as the liquid, the self-aggregating molecular film of the sulfur compound containing an alkyl base acts as a high-affinity region, while the self-aggregating molecular film of the sulfur compound containing an OH or $CO_2H$ group acts as the low-affinity region. Thus, in configuring the affinity regions, it is only necessary to change the sulfur compound used for forming the thiolate according to the liquid used.

INDUSTRIAL APPLICABILITY

As based on the liquid jetting structure of the present invention, a point of discontinuity is provided where the degree of affinity changes very rapidly, wherefore liquid droplet separation at a specific place inside the nozzle becomes possible. For this reason it is possible to stably produce significant points for producing liquid droplets, to stabilize liquid droplet diameter, and to secure the linearity of advance of the liquid droplets jetted. Accordingly, in printer applications, it is possible to improve print quality, and in industrial applications, it is possible to effect high-quality patterning, etc.

As based on the liquid jetting structure of the present invention, a configuration is comprised wherewith the fluid resistance of the liquid inside the nozzle can be lowered, wherefore the liquid can be jetted with small load.

As based on the liquid jetting structure of the present invention, a configuration is comprised wherewith it is possible to dynamically alter the affinity for a liquid on the inside of the nozzle, wherefore it is possible to stably produce significant points for producing liquid droplets, to stabilize liquid droplet diameter, and to secure the linearity of advance of the liquid droplets jetted.

What is claimed is:

1. A liquid jetting structure comprising:

at least one nozzle for jetting a liquid, wherein:

said nozzle comprises a base layer having a surface defining a flow path;

layers deposited on the surface of the base layer of the flow path sequentially along the length of the flow path, having a substantially uniform thickness, and having varying degrees of affinity for the liquid to be jetted; and if a molecular film deposited on the layers along the length of the flow path, wherein the degree of affinity for the liquid to be jetted varies along a direction of the flow path through the nozzle.

2. The liquid jetting structure according to claim 1, wherein said molecular film comprises a thiolate in which a prescribed sulfur compound has been coagulated on the layers.

3. The liguid jetting structure according to claim 2, wherein said sulfur compound is configured of a thiol compound represented by chemical formula R—SH where R is a hydrocarbon group.

4. The liquid jetting structure according to claim 3, wherein:

n, m, p, and q are any natural numbers; and

X and Y are prescribed elements, whereby

R is represented by any of the following composition formulas:

$C_nH_{2n+1}$—,
$C_nF_{2n+1}$—,
$C_nF_{2n+1}$—$C_mH_{2m}$—,
$C_nF_{2n+1}$—$(CH_2)_m$—X—C≡C—C≡C—C—Y—$(CH_2)_p$—
$HO_2C(CH_2)_n$—,
$HO(CH_2)_n$—,
$NC(CH_2)_n$—,
$H_{2n+1}C_n$—$O_2C$—$(CH_2)_m$—,
$H_3CO(CH_2)_n$—,
$X(CH_2)_n$— (where X is a halogen element),
$H_2C$=CH $(CH_2)_n$—
$H_3C$ $(CH_2)_n$—, or
$C_nF_{2n+1}$—$(CH_2)_m$—(NHCO—$CH_2)_p$—$(CH_2)_q$—.

5. The liquid jetting structure according to claim 2, wherein said sulfur compound is configured of a thiol molecule mixture represented by mutually differing chemical structural formulas $R^1$—SH and $R^2$—SH, where $R^1$ and $R^2$ represent different hydrocarbon groups.

6. The liquid jetting structure according to claim 5, wherein said $R^1$ and $R^2$ are represented by one of following chemical structural formulas, that is, by $C_nF_{2n+1}$— or $C_nF_{2n+1}$—$C_mH_{2m}$—.

7. The liquid jetting structure according to claim 2, wherein said sulfur compound is configured of a thiol compound represented by chemical structural formula HS—$R^3$—SH, where $R^3$ is a prescribed hydrocarbon group.

8. The liquid jetting structure according to claim 7, where said $R^3$ is represented by any of following chemical structural formulas, namely by

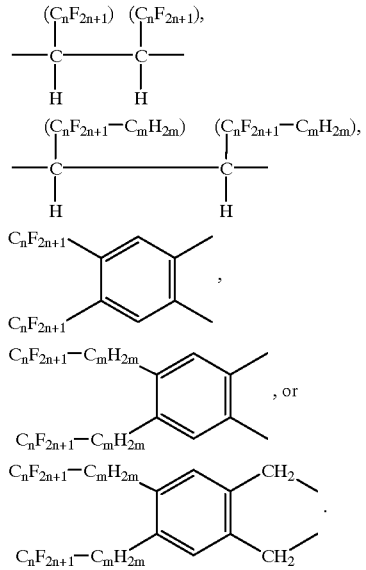

9. The liquid jetting structure according to claim 2, wherein, in said sulfur compound, a thiol compound represented by chemical structural formula $R^4$—S—S—$R^4$, where $R^4$ is a prescribed hydrocarbon group, is formed, either partially or wholly.

10. The liquid jetting structure according to claim 9, wherein, if n, m, p, and q are any natural numbers and X and Y are prescribed elements, then $R^4$ is represented by any of following chemical structural formulas, that is, by $C_nH_{2n+1}$—,
$C_nF_{2n+1}$—, $C_nF_{2n+1}$—$C_mH_{2m}$—, $C_nF_{2n+1}$—$(CH_2)_m$—X—C≡C—C≡C—C—Y—$(CH_2)_p$—

$HO_2C(CH_2)_n$—, $HO(CH_2)_n$—, $NC(CH_2)_n$—, $H_{2n+1}C_n$—$O_2C$—$(CH_2)_m$—, $H_3CO(CH_2)_n$—, $X(CH_2)_n$— (where X is a halogen element such as Br, Cl, or I, etc.)

$H_2C{=}CH(CH_2)_n$—

$H_3C(CH_2)_n$—, or $C_nF_{2n+1}$—$(CH_2)_m$—(NHCO—$CH_2)_p$—$(CH_2)_q$—.

11. The liquid jetting structure according to any one of claims 1 to 10, wherein said flow path is provided with a point of discontinuity where said degree of affinity for said liquid to be jetted declines precipitously from an upstream end of the flow path toward a downstream end of the flow path.

12. The liquid jetting structure according to claim 11, wherein the degree of affinity for said liquid in said flow path is set to be relatively low.

13. The liquid jetting structure according to claim 11, wherein an inner surface of a reservoir for supplying said liquid to said flow path is set so that a degree of affinity of the inner surface of the reservoir for said liquid becomes relatively high.

14. The liquid jetting structure according to claim 11, wherein the liquid jetting structure is implemented in an ink jet recording head.

15. The liquid jetting structure according to any one of claims 1 to 10, wherein said flow path is provided on a downstream end thereof with a region having a length of between 1 $\mu$m and 100 $\mu$m wherein the degree of affinity for said liquid to be jetted is relatively low.

16. The liquid jetting structure according to claim 15, wherein the degree of affinity for said liquid in said flow path is set to be relatively low.

17. The liquid jetting structure according to claim 15, wherein an inner surface of a reservoir for supplying said liquid to said flow path is set so that a degree of affinity of the inner surface of the reservoir for said liquid becomes relatively high.

18. The liquid jetting structure according to claim 15, wherein the liquid jetting structure is implemented in an ink jet recording head.

19. The liquid jetting structure according to any one of claims 1 to 10, wherein said degree of affinity for said liquid to be jetted gradually increases from an upstream end of the flow path toward a downstream end of the flow path.

20. The liquid jetting structure according to claim 19, wherein the degree of affinity for said liquid in said flow path is set to be relatively low.

21. The liquid jetting structure according to claim 19, wherein an inner surface of a reservoir for supplying said liquid to said flow path is set so that a degree of affinity of the inner surface of the reservoir for said liquid becomes relatively high.

22. The liquid jetting structure according to claim 19, wherein the liquid jetting structure is implemented in an ink jet recording head.

23. The liquid jetting structure according to claim 1, wherein said flow path is provided on a downstream end thereof with a layer wherein the degree of affinity for said liquid to be jetted can be varied in response to changes in a physical quantity comprising one or more of heat, electric field strength, and magnetic field strength.

24. The liquid jetting structure according to claim 23, further comprising means for supplying one or more of said physical quantities.

25. The liquid jetting structure according to any one of claims 1 to 10, 23, and 24, wherein the degree of affinity along said flow path from which said liquid is jetted is set so that the degree of affinity for said liquid is relatively low.

26. The liquid jetting structure according to claim 25, wherein an inner surface of a reservoir for supplying said liquid to said flow path is set so that a degree of affinity of the inner surface of the reservoir for said liquid becomes relatively high.

27. The liquid jetting structure according to claim 25, wherein the liquid jetting structure is implemented in an ink jet recording head.

28. The liquid jetting structure according to any one of claims 10,14 and 15, wherein inner surface of a reservoir for supplying said liquid to said flow path is set so that degree of affinity for said liquid becomes relatively high.

29. The liquid jetting structure according to claim 28, wherein the liquid jetting structure is implemented in an ink jet recording head.

30. An ink jet recording head comprising a liquid jetting structure, the liquid jetting structure comprising:

at least one nozzle for jetting a liquid, wherein:

said nozzle comprises a base layer having a surface defining a flow path;

layers deposited on the surface of the base layer of the flow path sequentially along the length of the flow path, having a substantially uniform thickness, and having varying degrees of affinity for the liquid to be jetted; and a molecular film deposited on the layers along the length of the flow path, wherein the degree of affinity for the liquid to be jetted varies along a direction of the flow path through the nozzle.

31. The ink jet recording head according to claim 30, wherein said sulfur compound is configured of a thiol compound represented by chemical formula R—SH where R is a hydrocarbon group.

32. The ink jet recording head according to claim 31, wherein said molecular film comprises a thiolate in which a prescribed sulfur compound has been coagulated on the layers.

33. The ink jet recording head according to claim 32, wherein:

n, m, p, and q are any natural numbers; and

X and Y are prescribed elements, whereby

R is represented by any of the following composition formulas:

$C_nH_{2n+1}$—, $C_nF_{2n+1}$—, $C_nF_{2n+1}$—$C_mH_{2m}$—, $C_nF_{2n+1}$—$(CH_2)_m$—X—C≡C—C≡C—Y—$(CH_2)_p$—

$HO_2C(CH_2)_n$—, $HO(CH_2)_n$—, $NC(CH_2)_n$—, $H_{2n+1}C_n$—$O_2C$—$(CH_2)_m$—, $H_3CO(CH_2)_n$—, $X(CH_2)_n$—(where X is a halogen element),
$H_2C{=}CH(CH_2)_n$—,
$H_3C(CH_2)_n$—, or
$C_nF_{2n+1}$—$(CH_2)_m$—$(NHCO—CH_2)_p$—$(CH_2)_q$—.

34. The ink jet recording head according to claim 31, wherein said sulfur compound is configured of a thiol molecule mixture represented by mutually differing chemical structural formulas $R^1$—SH and $R^2$—SH, where $R^1$ and $R^2$ represent different hydrocarbon groups.

35. The ink jet recording head according to claim 34, wherein said $R^1$ and $R^2$ are represented by one of $C_nF_{2n+1}$— and $C_nF_{2n+1}$—$C_mH_{2m}$—.

36. The ink jet recording head according to claim 31, wherein said sulfur compound is configured of a thiol compound represented by chemical structural formula HS—$R^3$—SH, where $R^3$ comprises a prescribed hydrocarbon group.

37. The ink jet recording head according to claim 36, wherein said $R^3$ is represented by any of the following chemical structural formulas:

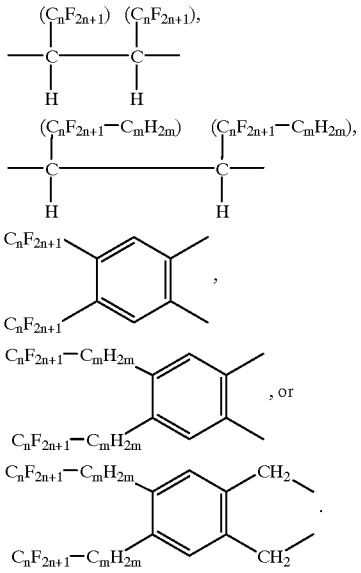

38. The ink jet recording head according to claim 31, wherein, in said sulfur compound, a thiol compound represented by chemical structural formula $R^4$—S—S—$R^4$, where $R^4$ is a prescribed hydrocarbon group, is formed, either partially or wholly.

39. The ink jet recording head according to claim 38, wherein:

n, m, p, and q are any natural numbers; and

X and Y are prescribed elements, whereby $R^4$ is represented by any of the following chemical structural formulas:

$C_nH_{2n+1}$—,
$C_nF_{2n+1}$—,
$C_nF_{2n+1}$—$C_mH_{2m}$—,
$C_nF_{2n+1}$—$(CH_2)_m$—X—C≡C—C≡C—Y—$(CH_2)_p$—,
$HO_2C(CH_2)_n$—,
$HO(CH_2)_n$—,
$NC(CH_2)_n$—,
$H_{2n+1}C_n$—$O_2C$—$(CH_2)_m$—,
$H_3CO(CH_2)_n$—,
$X(CH_2)_n$—(where X is a halogen element),
$H_2C{=}CH(CH_2)_n$—,
$H_3C(CH_2)_n$—, or
$C_nF_{2n+1}$—$(CH_2)_m$—$(NHCO—CH_2)_p$—$(CH_2)_q$—.

40. The ink jet recording head according to claim 30, wherein said flow path is provided with a point of discontinuity where said degree of affinity for said liquid to be jetted declines precipitously from an upstream end of the flow path toward a downstream end of the flow path.

41. The ink jet recording head according to claim 30, wherein said flow path is provided on a downstream end thereof with a region having a length of between 1 μm and 100 μm wherein the degree of affinity for said liquid to be jetted is relatively low.

42. The ink jet recording head according to claim 30, wherein said degree of affinity for said liquid to be jetted gradually increases from an upstream end of the flow path toward a downstream end of the flow path.

43. The ink jet recording head according to claim 30, wherein said flow path is provided on a downstream end thereof with a layer wherein the degree of affinity for said liquid to be jetted can be varied in response to changes in a physical quantity comprising one or more of heat, electric field strength, and magnetic field strength.

44. The ink jet recording head according to claim 43, further comprising means for supplying one or more of said physical quantities.

45. The ink jet recording head according to claim 30, wherein the degree of affinity along said flow path from which said liquid is jetted is set so that the degree of affinity for said liquid is relatively low.

46. The ink jet recording head according to claim 30, wherein an inner surface of a reservoir for supplying said liquid to said flow path is set so that a degree of affinity of the inner surface of the reservoir for the liquid is relatively high.

47. The ink jet recording head according to claim 30, wherein the liquid jetting structure is implemented in an ink jet recording head.

48. The ink jet recording head according to claim 30, wherein the liquid jetting structure is implemented in a printer.

49. A liquid jetting device comprising a liquid jetting structure, the liquid jetting structure comprising:

at least one nozzle for jetting a liquid, wherein:

said nozzle comprises a base layer having a surface defining a flow path;

layers deposited on the surface of the base layer of the flow path sequentially along the length of the flow path, having a substantially uniform thickness, and having varying degrees of affinity for the liquid to be jetted; and a molecular film deposited on the layers along the length of the flow path, wherein the degree of affinity for the liquid to be jetted varies along a direction of the flow path through the nozzle.

50. The liquid jetting device according to claim 49, wherein said sulfur compound is configured of a thiol compound represented by chemical formula R—SH where R is a hydrocarbon group.

51. The liquid jetting device according to claim 50, wherein said molecular film comprises a thiolate in which a prescribed sulfur compound has been coagulated on the layers.

52. The liquid jetting device according to claim 51, wherein:

n, m, p, and q are any natural numbers; and

X and Y are prescribed elements, whereby

R is represented by any of the following composition formulas:

$C_nH_{2n+1}$—,
$C_nF_{2n+1}$—,
$C_nF_{2n+1}$—$C_mH_{2m}$—,
$C_nF_{2n+1}$—$(CH_2)_m$—X—C≡C—C≡C—Y—$(CH_2)_p$—
$HO_2C(CH_2)_n$—,
$HO(CH_2)_n$—,
$NC(CH_2)_n$—,
$H_{2n+1}C_n$—$O_2C$—$(CH_2)_m$—,
$H_3CO(CH_2)_n$—,
$X(CH_2)_n$—(where X comprises a halogen element),
$H_2C$=$CH(CH_2)_n$—,
$H_3C(CH_2)_n$—, or
$C_nF_{2n+1}$—$(CH_2)_m$—$(NHCO—CH_2)_p$—$(CH_2)_q$—.

53. The liquid jetting device according to claim 50, wherein said sulfur compound is configured of a thiol molecule mixture represented by mutually differing chemical structural formulas $R^1$—SH and $R^2$—SH, where $R^1$ and $R^2$ represent different hydrocarbon groups.

54. The liquid jetting device according to claim 50, wherein said $R^1$ and $R^2$ are represented by one of $C_nF_{2n+1}$— and $C_nF_{2n+1}$—$C_mH_{2m}$—.

55. The liquid jetting device according to claim 53, wherein said sulfur compound is configured of a thiol compound represented by chemical structural formula HS—$R^3$—SH, where $R^3$ comprises a prescribed hydrocarbon group.

56. The liquid jetting device according to claim 55, wherein said $R^3$ is represented by any of the following chemical structural formulas:

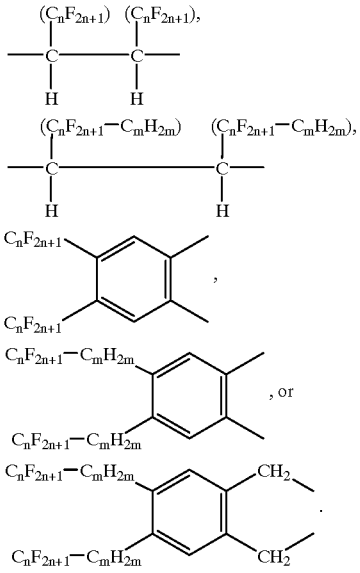

57. The liquid jetting device according to claim 50, wherein, in said sulfur compound, a thiol compound represented by chemical structural formula $R^4$—S—S—$R^4$, where $R^4$ is a prescribed hydrocarbon group, is formed, either partially or wholly.

58. The liquid jetting device according to claim 57, wherein:

n, m, p, and q are any natural numbers; and

X and Y are prescribed elements, whereby $R^4$ is represented by any of the following chemical structural formulas:

$C_nH_{2n+1}$—,
$C_nF_{2n+1}$—,
$C_nF_{2n+1}$—$C_mH_{2m}$—,
$C_nF_{2n+1}$—$(CH_2)_m$—X—C≡C—C≡C—Y—$(CH_2)_p$—,
$HO_2C(CH_2)_n$—,
$HO(CH_2)_n$—,
$NC(CH_2)_n$—,
$H_{2n+1}C_n$—$O_2C$—$(CH_2)_m$—,
$H_3CO(CH_2)_n$—,
$X(CH_2)_n$—(where X comprises a halogen element),
$H_2C$=$CH(CH_2)_n$—,
$H_3C(CH_2)_n$—, or
$C_nF_{2n+1}$—$(CH_2)_m$—$(NHCO—CH_2)_p$—$(CH_2)_q$—.

59. The liquid jetting device according to claim 49, wherein said flow path is provided with a point of discontinuity where said degree of affinity for said liquid to be jetted declines precipitously from an upstream end of the flow path toward a downstream end of the flow path.

60. The liquid jetting device according to claim 49, wherein said flow path is provided on a downstream end thereof with a region having a length of between 1 μm and 100 μm wherein the degree of affinity for said liquid to be jetted is relatively low.

61. The liquid jetting device according to claim 49, wherein said degree of affinity for said liquid to be jetted gradually increases from an upstream end of the flow path toward a downstream end of the flow path.

62. The liquid jetting device according to claim 49, wherein said flow path is provided on a downstream end thereof with a layer wherein the degree of affinity for said liquid to be jetted can be varied in response to changes in a physical quantity comprising one or more of heat, electric field strength, and magnetic field strength.

63. The liquid jetting device according to claim 62, further comprising means for supplying one or more of said physical quantities.

64. The liquid jetting device according to claim 49, wherein the degree of affinity along said flow path from which said liquid is jetted is set so that the degree of affinity for said liquid is relatively low.

65. The liquid jetting device according to claim 49, wherein an inner surface of a reservoir for supplying said liquid to said flow path is set so that a degree of affinity of the inner surface of the reservoir for the liquid is relatively high.

66. The liquid jetting device according to claim 49, wherein the liquid jetting structure is implemented in an ink jet recording head.

67. The liquid jetting device according to claim 49, wherein the liquid jetting structure is implemented in a printer.

* * * * *